US007419392B2

(12) United States Patent
Tsuji

(10) Patent No.: US 7,419,392 B2
(45) Date of Patent: Sep. 2, 2008

(54) CONNECTOR AND CONNECTOR ASSEMBLY

(75) Inventor: Takeshi Tsuji, Yokkaichi (JP)

(73) Assignee: Sumitomo Wiring Systems Ltd (JP)

( * ) Notice: Subject to any disclaimer, the term of this patent is extended or adjusted under 35 U.S.C. 154(b) by 0 days.

(21) Appl. No.: 11/710,668

(22) Filed: Feb. 23, 2007

(65) Prior Publication Data

US 2007/0199369 A1 Aug. 30, 2007

(30) Foreign Application Priority Data

Feb. 24, 2006 (JP) ..... 2006-048672

(51) Int. Cl.
*H01R 13/62* (2006.01)

(52) U.S. Cl. ..... 439/157

(58) Field of Classification Search ..... 439/157, 439/347, 489

See application file for complete search history.

(56) References Cited

U.S. PATENT DOCUMENTS

| | | | | |
|---|---|---|---|---|
| 5,238,417 | A | 8/1993 | Hatagishi | |
| 5,618,194 | A | 4/1997 | Maue et al. | |
| 5,871,363 | A * | 2/1999 | Kimura | 439/157 |
| 6,017,236 | A | 1/2000 | Yoshida et al. | |
| 6,254,407 | B1 | 7/2001 | Burns | |
| 6,641,423 | B1 * | 11/2003 | Giro | 439/347 |
| 6,890,194 | B2 * | 5/2005 | Katsuma | 439/157 |
| 2001/0019908 | A1 * | 9/2001 | Zweigle | 439/157 |
| 2003/0082940 | A1 * | 5/2003 | Yamashita | 439/157 |
| 2003/0109155 | A1 * | 6/2003 | Yamashita | 439/157 |
| 2003/0216071 | A1 * | 11/2003 | Katsuma | 439/157 |
| 2005/0048820 | A1 * | 3/2005 | Yamashita | 439/157 |
| 2005/0106911 | A1 * | 5/2005 | Sharples et al. | 439/157 |

FOREIGN PATENT DOCUMENTS

| | | |
|---|---|---|
| JP | 2003-338344 | 11/2003 |
| WO | WO 97/07567 | 2/1997 |
| WO | WO 99/38230 | 7/1999 |

* cited by examiner

*Primary Examiner*—Tulsidas C. Patel
*Assistant Examiner*—Vladimir Imas
(74) *Attorney, Agent, or Firm*—Gerald E. Hespos; Anthony J. Casella

(57) ABSTRACT

A connector is provided with a first housing (10), a second housing (20), a slider (30) and a detector (40). The detector (40) includes rotary shafts (43A) and the first housing (10) includes rotation supports (19B) into which the rotary shafts (43A) are fit to rotatably support the detector (40). Thus, when the detector (40) is viewed from the back side of the first housing (10), whether a position of a pressing portion (44) projected on the first housing (10) is aligned with a recess (26A) changes before and after a movement of the detector (40). Therefore, a detecting operation of the detector (40) can be confirmed easily.

16 Claims, 23 Drawing Sheets

CONNECTOR AND CONNECTOR ASSEMBLY

BACKGROUND OF THE INVENTION

1. Field of the Invention

The invention relates to a connector and to a connector assembly.

2. Description of the Related Art

Japanese Unexamined Patent Publication No. 2003-338344 discloses a connector with first and second housings that are connectable with one another. The connector employs a slider as a force multiplying mechanism to assist in the connection of the housings. The connector further has a detector that is movable straight along a direction normal to moving directions of the slider after the slider is slid to connect the housings completely.

An operator must judge from the external appearance whether the detector has reached a detecting position. However, the line of sight of the operator may lie at a back side with respect to a moving direction of the detector in certain installations and the operator may be unable to confirm the detecting operation before and after the movement of the detector. In such a case, there is a problem of difficulty in confirming the detecting operation.

The invention was developed in view of this problem and an object thereof is to make it easier to confirm a detecting operation of a detecting member.

SUMMARY OF THE INVENTION

The invention relates to a connector with a housing that is connectable with a mating housing that is formed with a mating cam. A movable member is assembled to the housing for movement at an angle to a connecting direction of the housing with the mating housing. The movable member has at least one cam that is engageable with the mating cam to generate a cam action for connecting the housing and the mating housing as the movable member is moved. A detector is assembled to the housing and can move to a detecting position when the movable member is at an operation completion position. However, the detector cannot move to the detecting position during the operation of the movable member. The detector preferably is mounted rotatably and is exposed at an outer surface of the housing.

The housing and the mating housing initially are fit lightly together. The movable member then is moved so that the cam generates the cam action with the mating cam. As a result, the housing reaches a properly connected state with the mating housing. The detector then is moved from the initial position towards the detecting position. Movement of the detector to the detecting position confirms that the movable member is at the proper position and that the housing is connected properly with the mating connector housing.

The detector interferes with the housing and cannot be moved to the detecting position if the movable member has been operated incompletely. Thus, an operator can know that the housing is not connected properly with the mating housing.

The detector preferably is displaced through a rotational movement rather than through the prior art parallel movement. A projected position of a specific part of the prior art detector on the housing is the same at the initial position and at the detecting position due to the parallel movement of the prior art detector. Thus, the external appearance does not permit an operator to judge accurately whether the detector has reached the detecting position, particularly if the gaze of the operator lies at a back side with respect to a moving direction of the detector. Thus, the operator may not be able to recognize a difference between the detecting position and the initial position. However, the rotationally movable detector of the subject invention projects differently at the initial position and at the detecting position and can be observed even though the gaze or line of sight of the operator is at the position described above. Therefore, the operator can clearly recognize whether the detector has reached the detecting position.

The invention also relates to a connector assembly comprising the above-described connector and a mating connector connectable therewith.

The mating cam preferably is a follower pin, and the movable member preferably is a slider slidably assembled to the housing for movement in a direction normal to a connecting direction of the housings. The cam of the slider preferably is a cam groove that engages the follower pin to generate a cam action that connects or disconnects the housings as the slider is moved. The detector preferably is mounted rotatably to the outer surface of the housing and can move to the detecting position when the slider is at an operation completing position. However, the detector cannot move to the detecting position during the operation of the slider.

The housings initially are fit lightly together and then the slider is moved. As a result, the follower pin travels along the cam groove and moves the two housings to a properly connected state. The detector then is rotated from the initial position and can be advanced rotatably to the proper position if the housings have been connected properly. However, the detector interferes with the housing and cannot be moved to the detecting position if the slider has been operated incompletely. An operator can readily judge the projecting position of the rotationally mounted detector and therefore knows whether the housings are connected properly.

The detector preferably is assembled for substantially facing an entrance path for the movable member in the housing. One of the detector and the movable member preferably has at least one detection rib that slides in contact with the other during the operation of the movable member to prevent the detector from being pushed towards the entrance path. The other of the detector and the movable member includes at least one detection hole that can receive the detection rib when the rib and the hole are aligned. Thus, the detector can be pushed to the detecting position only when the movable member substantially reaches the operation completing position. Accordingly, the arrival of the detector at the detecting position can be detected easily.

The detection rib preferably has at least one insufficient insertion correcting surface that slides in contact with the edge of the detection hole if the movable member is inserted insufficiently. A component of force of the insufficient insertion correcting surface acts in a direction to urge the movable member to the operation completing position. Accordingly, pushing forces on the detector can correct the insufficiently inserted state of the movable member. Conversely, a pulling force on the movable member from the operation completing position pushes the detecting rib out of the detection hole. Thus, the detecting member need not be operated separately, and operation efficiency can be improved.

The cam preferably has an operation area and a play area. The operation area is used for connecting the two housings. The play area is substantially continuous with the back end of the operation area and does not cause a connecting operation to progress after the complete connection even if the movable member is operated. The detection rib preferably is pushed into the detection hole while the mating is in the play area. The completely connected state of the two housings is guaranteed by the accommodation of the detector into the detection hole while the mating cam is in the play area.

The entrance path for the movable member preferably penetrates the housing in a width direction. Thus, the movable member can be assembled selectively from either widthwise side. Movement supports are provided at substantially symmetrical positions in the housing and make an assembling position of the detector selectable depending on an assembling direction of the movable member. Thus, the assembling direction of the movable member can be selected freely depending on the situation at an assembling site of the two housings, thus improving overall operability.

The same rotation supports preferably are used for either assembling position of the detector. Hence, two additional rotation supports are not needed, thereby simplifying the construction and saving space.

The detector preferably includes movement preventing means for engaging the housing and locking the detector in the detecting position. The movement preventing means preferably includes at least one resiliently deformable lock on one of the detector and the housing and an interlocking portion provided at the other. The lock deforms and moves over the interlocking portion. However, the lock then restores and engages the interlocking portion. Accordingly, the detecting operation can be confirmed by the feeling given upon the engagement of the lock and the interlocking portion.

These and other features of the invention will become more apparent upon reading the following detailed description of preferred embodiments. Even though embodiments are described separately, single features may be combined to additional embodiments.

DETAILED DESCRIPTION OF THE PREFERRED EMBODIMENTS

Figure 1:
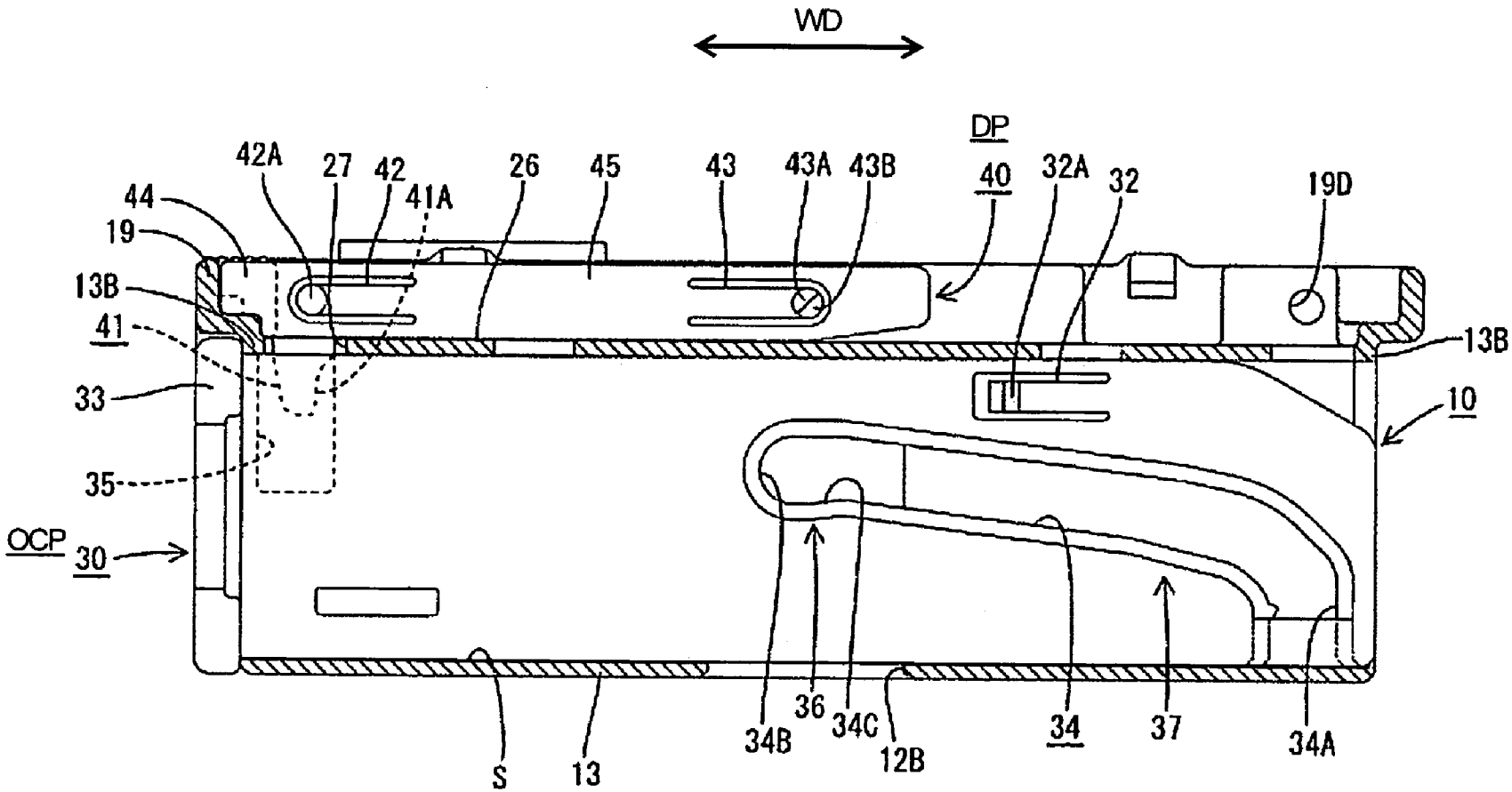
FIG. 1 is a horizontal section showing a state where a detector is at a detecting position before a connecting operation of first and second housings.

A connector according to the invention is described with reference to FIGS. 1 to 24. The connector has a first housing 10, a second housing 20, a slider 30 and a detector 40. The housings 10, 20 are connected by sliding the slider 30 and the completely connected state of the two housings 10, 20 can be detected if rotation of the detector 40 is permitted. In the following description, ends of the housings 10, 20 to be connected are referred to as the fronts and reference is made to FIG. 18 concerning the vertical and width directions.

Figure 12:
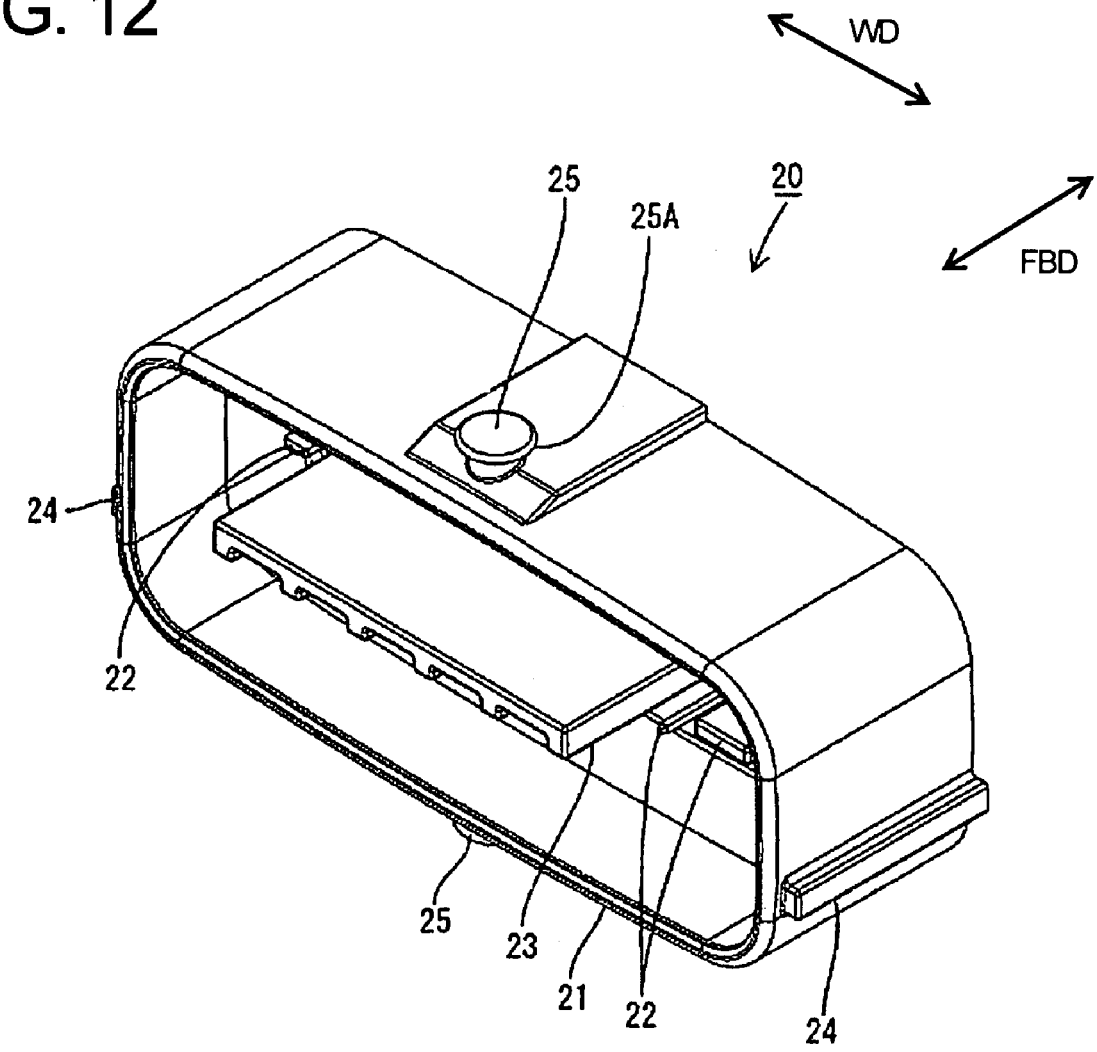
FIG. 12 is a perspective view of the second housing.

The second housing 20 is made e.g. of synthetic resin and includes a receptacle 21 having an open front, as shown in FIG. 12. Tab-shaped male terminal fittings 22 and a plate shaped guide 23 project forward from the back wall of the receptacle 21. Two guiding projections 24 are formed along the opposite widthwise sides of the outer surface of the receptacle 21 at relatively lower positions. Follower pins 25 project out substantially in the widthwise centers of the upper and lower outer surfaces of the receptacle 21 and flanges 25 project radially out at the projecting ends of the follower pins 25.

Figure 18:
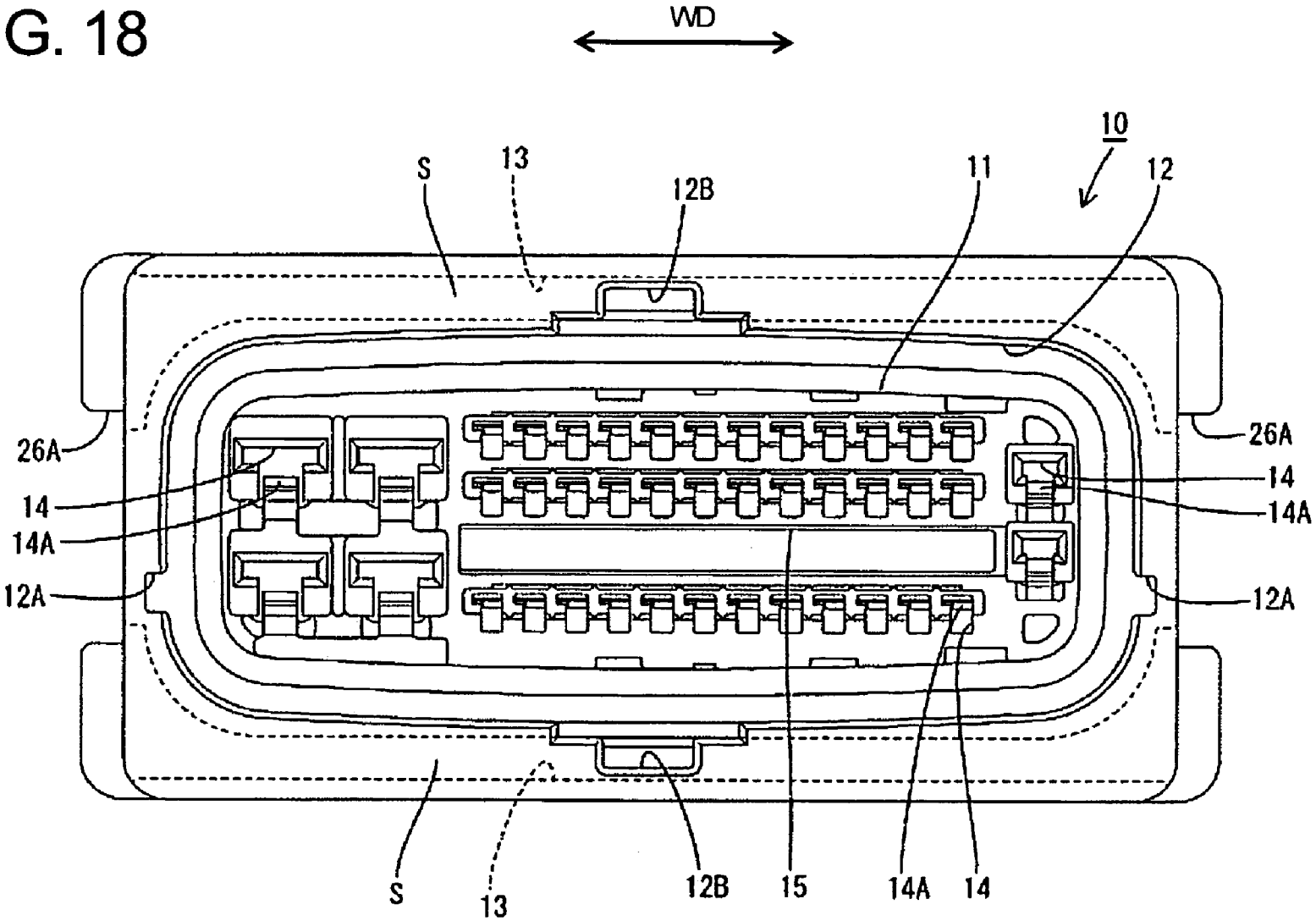
FIG. 18 is a front view of the first housing.

The first housing 10 is made e.g. of synthetic resin and is substantially in the form of a rectangular block, as shown in FIG. 18. A main portion 11 is formed inside the first housing 10 and also is a substantially rectangular block. A fitting tube 12 is formed around the main portion 11, and the receptacle 21 of the second housing 20 is insertable into a clearance between the main portion 11 and the fitting tube 12 as the two housings 10, 20 are connected. The male terminal fittings 22 fit into unillustrated female terminal fittings when the two housings 10, 20 are connected properly to establish electrical connections between the male and female terminal fittings.

Slider accommodating spaces S are formed above and below the fitting tube 12. The slider accommodating spaces S penetrate the first housing 10 in the width direction WD so that the slider 30 can be mounted from either widthwise side. Guiding recesses 12A are formed along forward and backward directions FBD at the opposite widthwise sides of the inner surface of the fitting tube 12 and can receive the guiding projections 24 of the second housing 20 to prevent an erroneous connection of the housings 10, 20.

Figure 10:
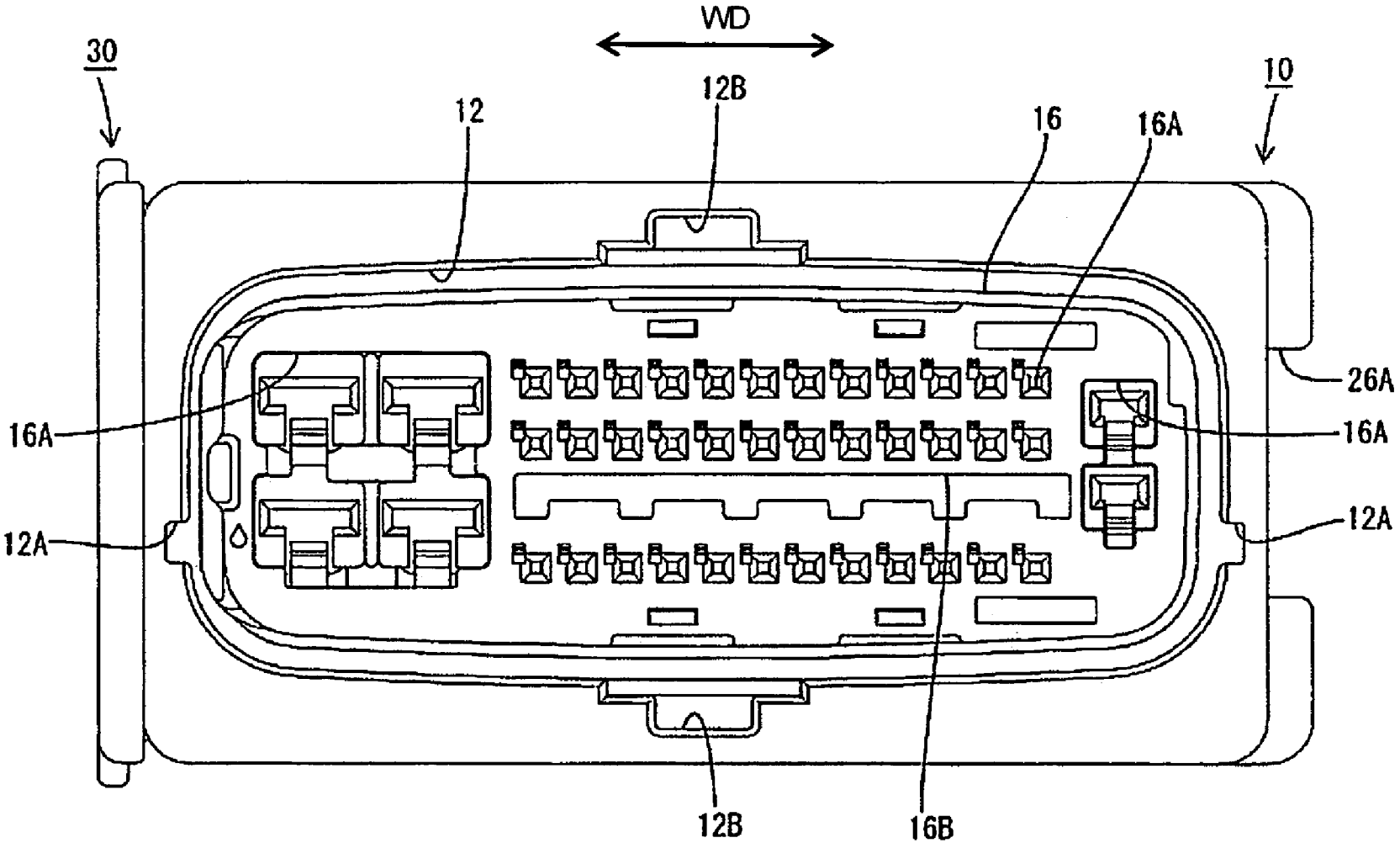
FIG. 10 is a front view showing a state where a slider is at an operation completing position before the connecting operation.

Cavities 14 penetrate the main portion 11 in forward and backward directions FBD. The cavities 14 have three different configurations corresponding to three different configurations of female terminal fittings that can be inserted into the cavities 14 from behind. The terminal fittings are retained at proper positions in the cavities 14 by locks 14A that cantilever forward in the cavities 14. A wide rectangular connection guiding hole 15 is formed at the front surface of the main portion 11 and can receive the guiding piece 23 of the second housing 20. As shown in FIG. 10, a front cap 16 is fittable to the front surface of the main portion 11. The front cap 16 is formed with through holes 16A corresponding to the cavities 14 and at least one through hole 16B corresponding to the connection guiding hole 15.

Figure 16:
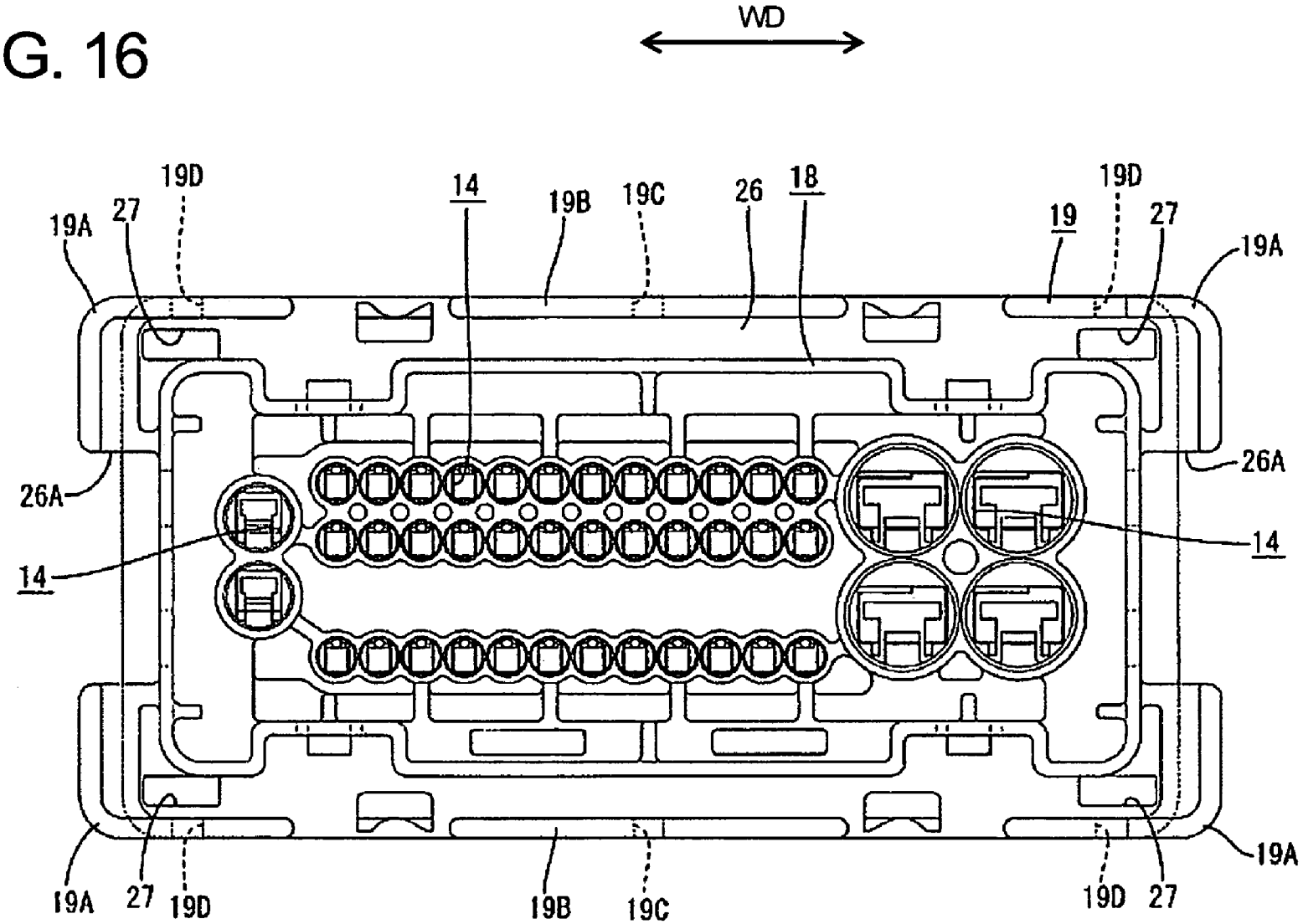
FIG. 16 is a rear view of the first housing.

An accommodating portion 26 is arranged at the outer periphery of the rear surface of the first housing 10, as shown in FIG. 16, for accommodating the detector 40 at a detecting position DP. The accommodating portion 26 is formed between an inner peripheral wall 18 arranged at a position to enclose the cavities 14 and an outer peripheral wall 19 outside the inner circumferential wall 18. The outer peripheral wall 19 is comprised of four substantially L-shaped portions 19A located at the four corners of the rear surface of the first housing 10 so that each L-shaped portion 19A has a horizontal section and a vertical section. Two rotation supports 19B are opposed vertically to each other between the horizontal sections of pairs of L-shaped portions 19A adjacent to each other in the width direction WD. The projecting height of the outer peripheral wall 19 is set substantially equal to the thickness of later-described arms 45 of the detector 40 in forward and backward directions FBD, so that the rear end edges of the arms 45 do not bulge out backward from the rear end edge of the outer peripheral wall 19 with the detector 40 fit in the accommodating portion 26, as shown in FIG. 1.

The vertical sections of the L-shaped portions 19A are outside the opposite side surfaces of the first housing 10 and face each other in the width direction WD. An operable portion 33 of the slider 30 is fit below the vertical sections of the L-shaped portions 19A when the slider 30 is at the operation completing position OCP, and the outer surfaces of the outer peripheral wall 19 and the operable portion 33 become substantially flush with each other, as shown in FIG. 1. The operation completing position OCP is an operating position of the slider 30 shown in FIG. 1 where the inner surface of the operable portion 33 is in contact with opening edges 13B of the slider accommodating spaces S and the slider 30 cannot be pushed any further.

As shown in FIG. 16, insertion holes 27 penetrate in forward and backward directions FBD between the horizontal sections of the L-shaped portions 19A and the inner peripheral wall 18. The insertion holes 27 have a substantially rectangular shape and detection ribs 41 of the detector 40 are insertable through the insertion holes 27. Mold removal holes left upon forming locking recesses 53 and the opposite widthwise ends of escaping spaces 52 to be described later are located at the opposite widthwise ends of the rotation supports 19B, and an unillustrated disengagement jig can be inserted through the mold removal holes to disengage upright surfaces of lock projections 32A and upright surfaces of the locking recesses 53 when the slider 30 is at a standby position SP, thereby enabling the slider 30 to be detached.

Round interlocking holes 19D vertically penetrate the horizontal sections of the L-shaped portions 19A at positions adjacent to the insertion holes 27. Locks 42 of the detector 40 to be described later are engageable with the edges of the interlocking holes 19D from the side of the accommodating portion 26. Further, round shaft holes 19C vertically penetrate the rotation supports 19B substantially in the widthwise centers.

Figure 8:
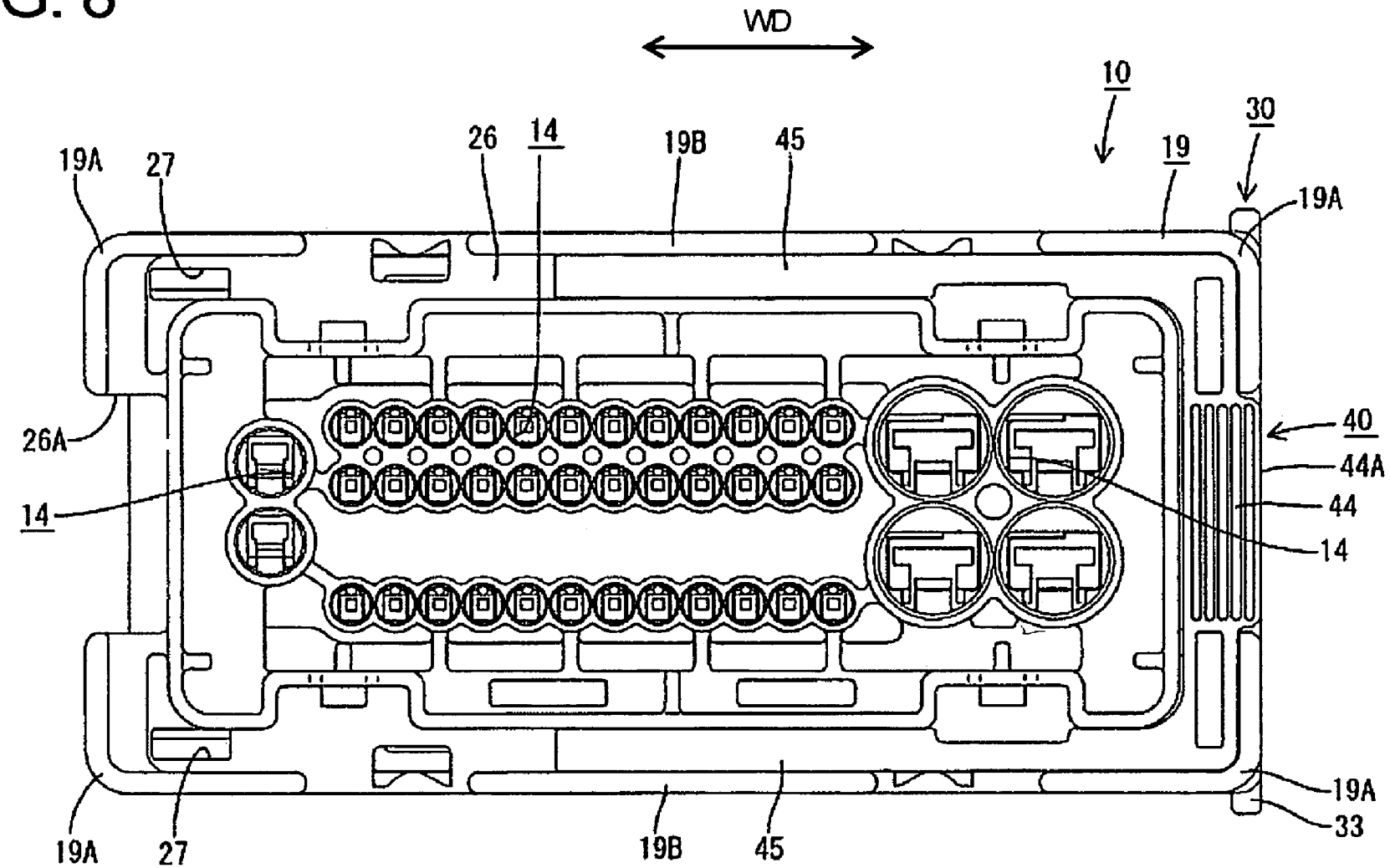
FIG. 8 is a rear view showing the state where the detector is at the detecting position before the connecting operation.

Recesses 26A are formed in parts of the accommodating portion 26 between the vertical sections of pairs of L-shaped portions 19A that are vertically adjacent to each other. A pressing portion 44 of the detector 40 can fit into the recess 26A as the detector 40 is rotated. The outer surface of the pressing portion 44 of the detector 40, the outer lateral surface of the outer peripheral wall 19 and the outer surface of the operable portion 33 of the slider 30 are substantially flush with each other when the detector 40 is accommodated in the accommodating portion 26 in this way. Accordingly, even when the first housing 10 shown in FIG. 8 is viewed from behind, the arrival of the detector 40 at the detecting position DP can be detected.

Figure 17:
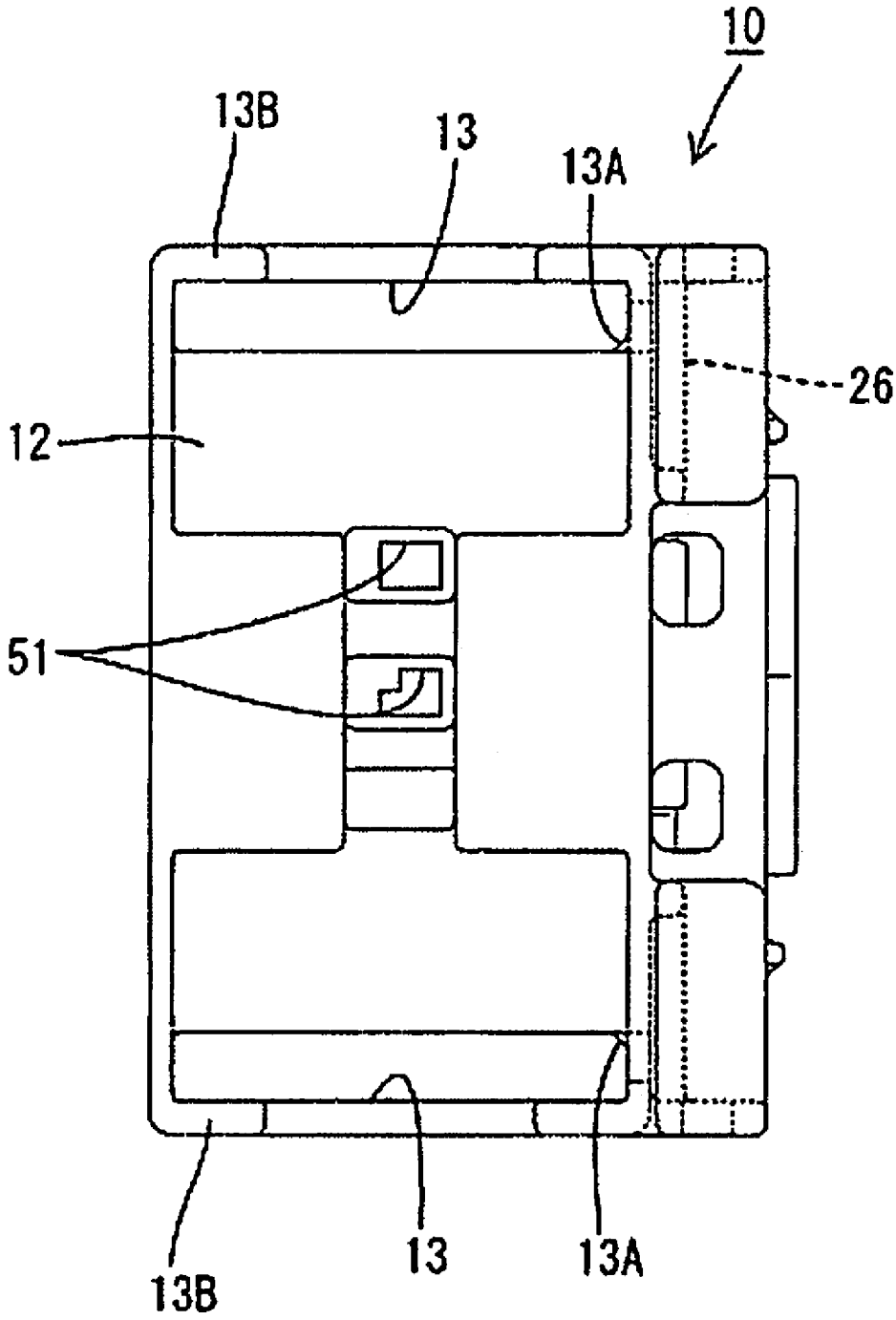
FIG. 17 is a side view of the first housing.

Substantially. rectangular upper and lower slider accommodating spaces S are defined above and below the fitting tube 12, as shown in FIG. 17. A slant 13A is formed along the width direction WD at a corner between a space defining portion 13 of each slider accommodating space S at the rear of the first housing 10 and another wall at the fitting tube 12. The slants 13A prevent an upside-down insertion of the slider 30 into the slider accommodating spaces S. The slants 13A face chamfered surfaces 31A of cam plates 31 if the slider 30 is in a proper posture and permit the insertion of the slider 30. However, the leading ends of the cam plates 31 interfere with the opening edges 13B of the slider accommodating spaces S if the slider 30 is in another posture to prevent the insertion.

Retainer accommodating holes 51 penetrate the centers of the opposite lateral surfaces of the first housing 10 in the width direction WD for accommodating side retainers 50. The side retainers 50 can be inserted into the retainer accommodating holes 51 to engage the rear ends of the female terminal fittings after the female terminal fittings are inserted to proper insertion positions in the cavities 14. Thus, the female terminal fittings are locked doubly by the locks 14A and the side retainers 50 to prevent the female terminal fittings from coming out.

Escaping grooves 12B are formed In the front surface of the first housing 10 at positions corresponding to the follower pins 25 of the second housing 20. As shown in FIG. 18, the escaping grooves 12B are cuts made substantially in the widthwise centers of the space defining portions 13, expanding from the front surface of the first housing 10 to the fitting tube 12 and extend substantially along entrance paths for the follower pins 25 so that the space before the first housing 10 and the slider accommodating spaces S communicate with each other. Thus, the follower pins 25 can enter the slider accommodating spaces S through the escaping grooves 12B when the two housings 10, 20 are connected.

Figure 13:
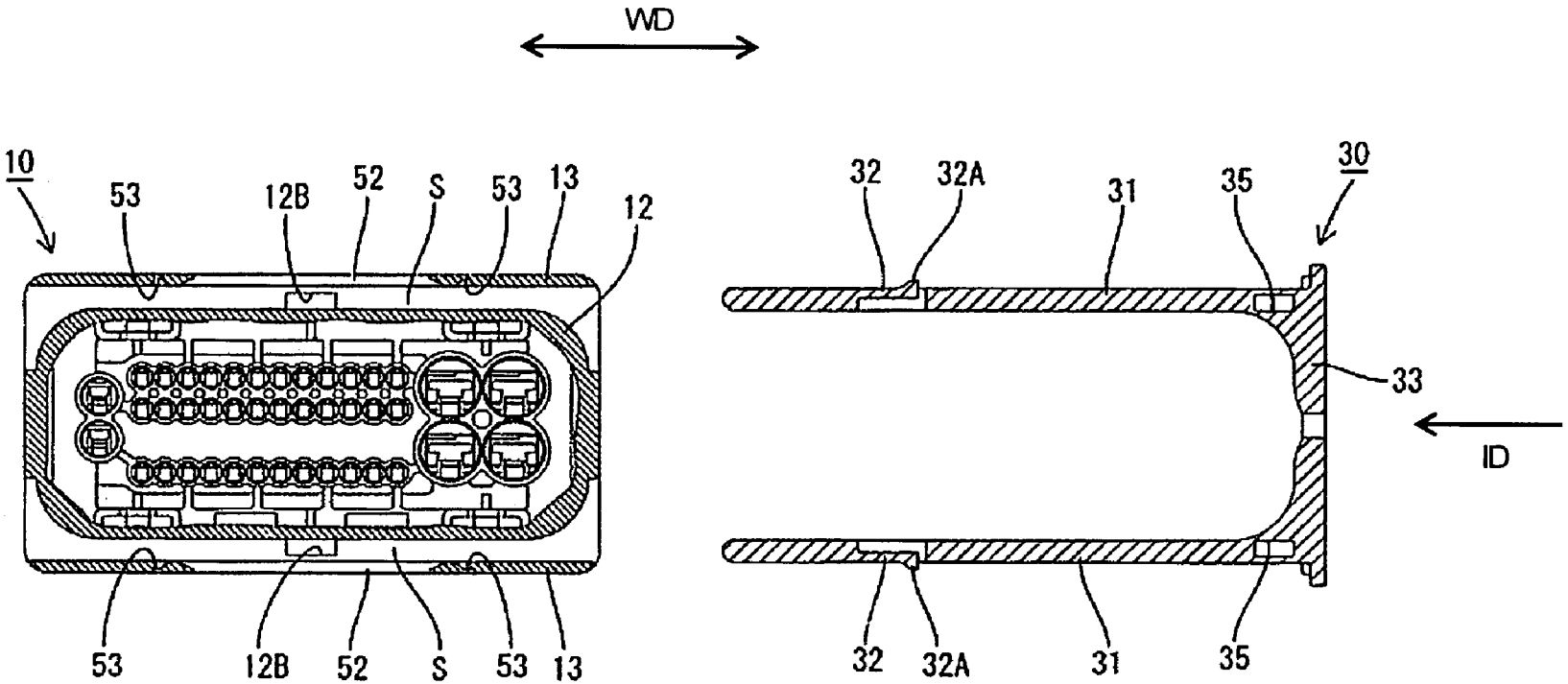
FIG. 13 is a vertical section showing a state where the slider and the first housing are assembled.
Figure 14:
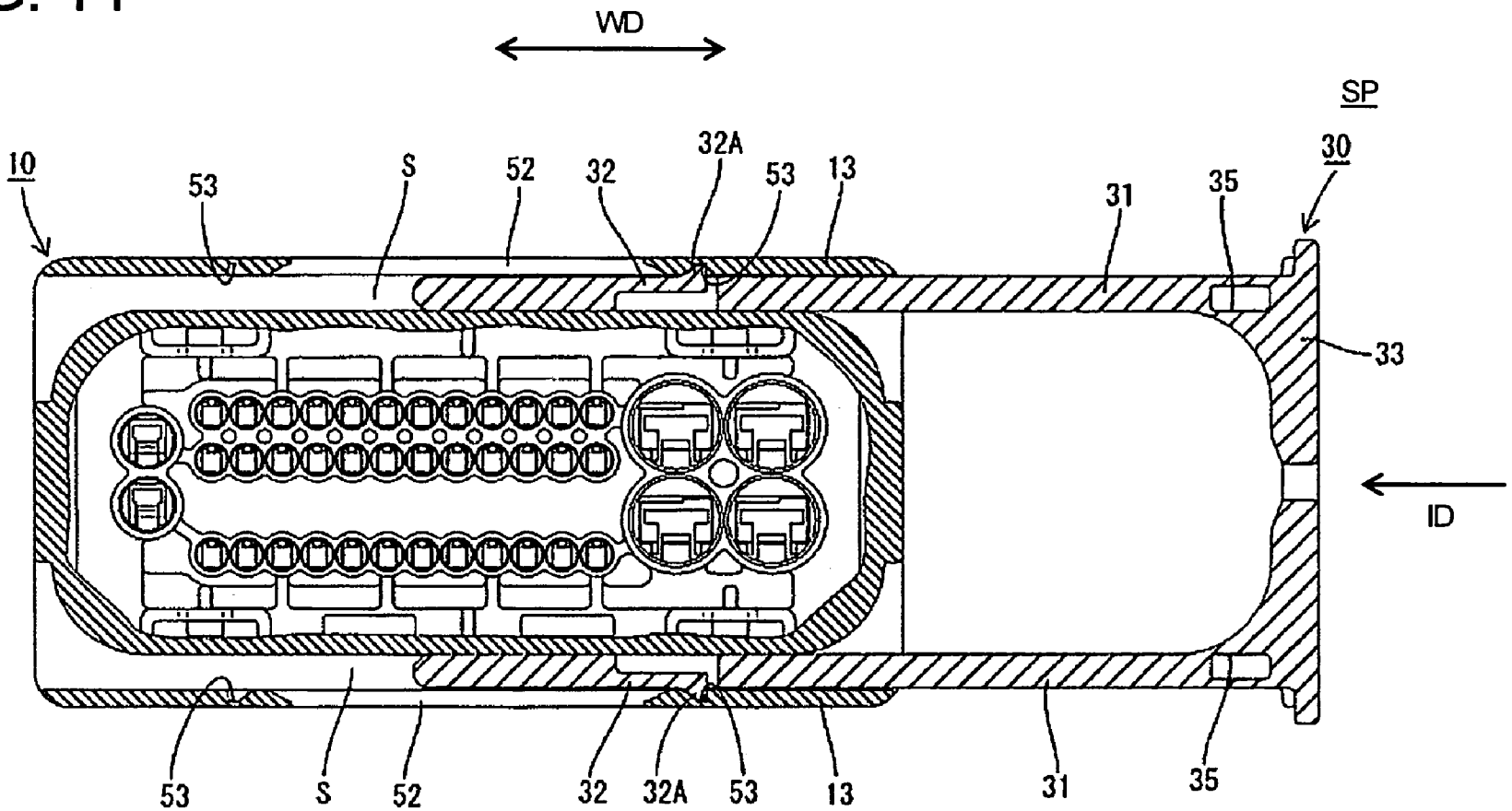
FIG. 14 is a vertical section showing a state where the slider is at a standby position.

As shown in FIG. 13, two locking recesses 53 are formed at a side of each space defining portion 13 facing the fitting tube 12 and are spaced apart by a specified distance in the width direction WD. The two locking recesses 53 are substantially transversely symmetrical with respect to an axis vertically passing the escaping grooves 12B. Two surfaces of each locking recess 53 substantially face each other in the width direction WD. The surface opposite to the escaping groove 12B is an upright surface arranged substantially normal to an inserting direction ID of the slider 30 and the one at the side of the escaping groove 12B has a moderate inclination. Lock projections 32A of the slider 30 can be fit in the locking recesses 53, as shown in FIG. 14, to hold the slider 30 at the standby position SP. The upright surfaces of the lock projections 32A engage the upright surfaces of the locking recesses 53 to prevent movement of the slider 30 in a detaching direction while permitting a movement of the slider 30 towards the operation completing position OCP. It should be noted that the standby position SP corresponds to an inserting position of the slider 30 in FIG. 3 where the follower pins 25 of the second housing 20 can be received into entrances 34A of cam grooves 34 through the escaping grooves 12B.

The escaping space 52 is formed along the width direction WD between the two locking recesses 53 in each space defining portion 13. The slider accommodating spaces S are exposed to the outside through the escaping spaces 52. The escaping grooves 52 are for avoiding the interference of lock projections 32A of the slider 30 and the space defining portions 13 until the slider 30 reaches the operation completing position OCP after the lock projections 32A move over the inclined surfaces of the locking recesses 53 at the sides of the escaping grooves 12B. This prevents an operating force from increasing during the operation of the slider 30. The escaping spaces 52 also enable the lock projections 32A to avoid being left deformed after the slider 30 reaches the operation completing position (see FIG. 15).

Figure 15:
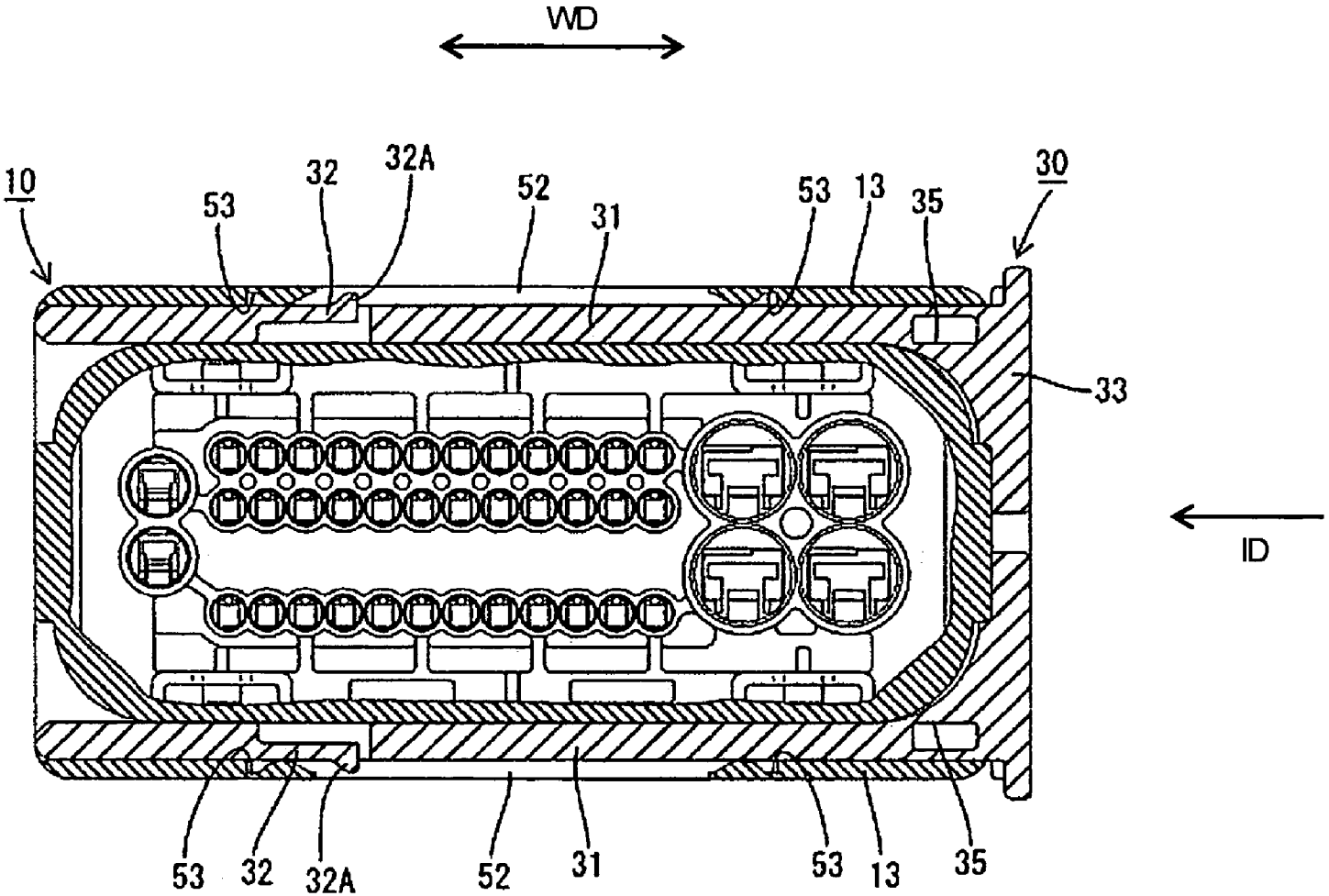
FIG. 15 is a vertical section showing a state where the slider is at the operation completing position.
Figure 21:
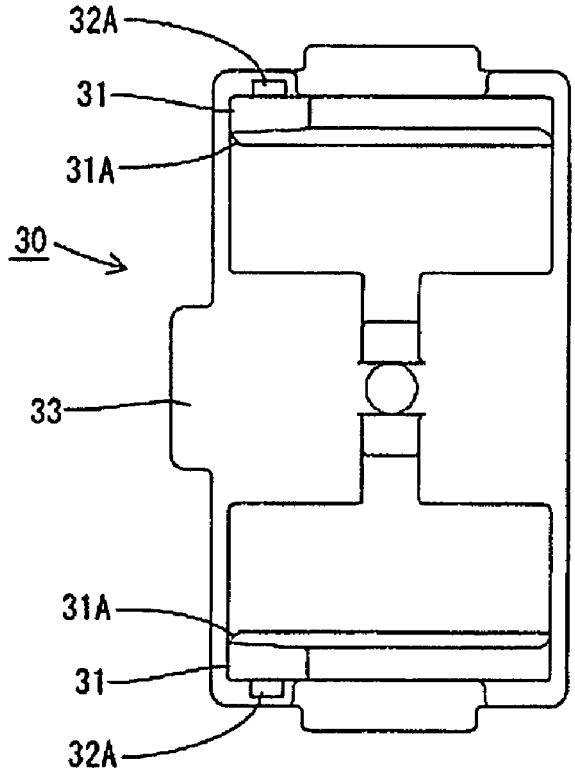
FIG. 21 is a side view of the slider.

The slider 30 is made e.g. of synthetic resin, and has a substantially U-shape that is open sideways. The slider 30 has an operable portion 33 and two cam plates 31 at opposite ends of the operable portion 33. As shown in FIGS. 13 to 15, the cam plates 31 can be inserted along the inserting direction ID into the slider accommodating spaces S. The slider 30 can be assembled from either widthwise side of the slider accommodating spaces S, so that an assembling direction can be selected depending on the situation at an assembling site of the housings 10 and 20. As shown in FIG. 21, chamfered surfaces 31A are formed at the rear ends of the inner surfaces of the cam plates 31 by cutting off corners substantially along width direction WD.

Figure 19:
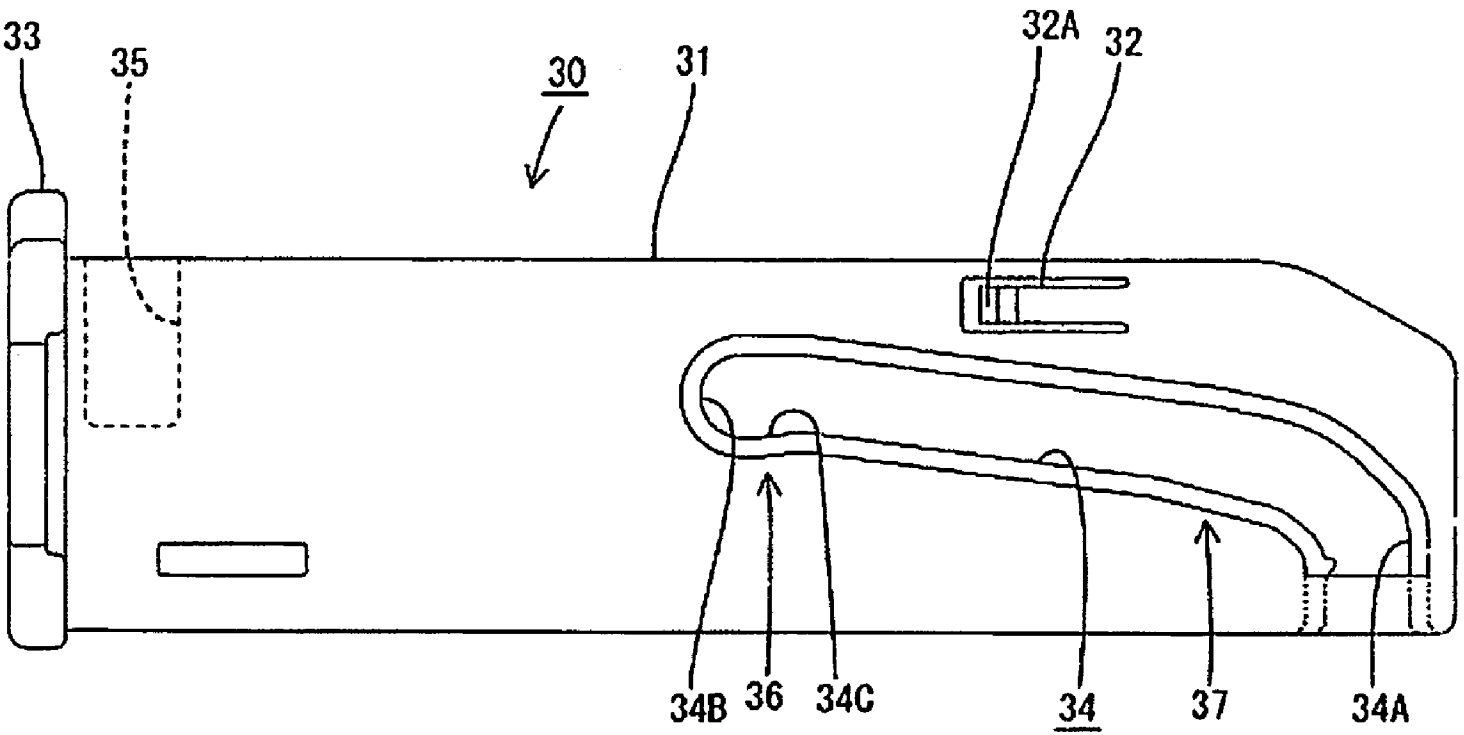
FIG. 19 is a plan view of the slider.
Figure 20:
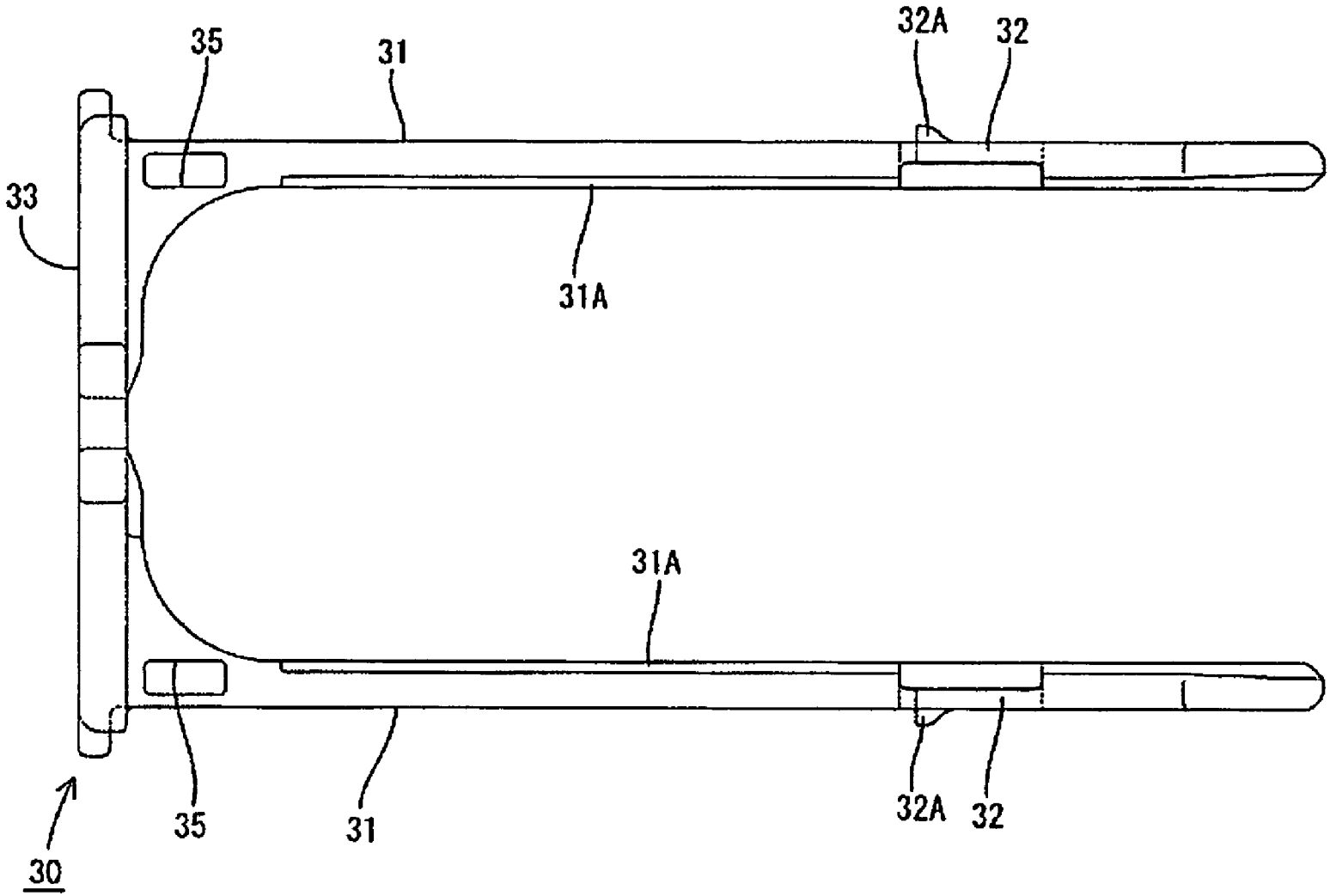
FIG. 20 is a front view of the slider.

As shown in FIG. 19, each cam plate 31 has a cam groove 34 engageable with the corresponding follower pin 25 of the second housing 20. The cam groove 34 penetrates the cam plate 31 in the thickness direction, and includes an operation area 37 for causing the two housings 10, 20 to reach the connected state. The cam groove 34 also has a play area 36 that is continuous with the back end of the operation area 37, but does not cause the connecting operation to progress beyond the complete connection even if the slider 30 is slid further. The inner edges of the cam grooves 34 bulge in substantially parallel with the plate surfaces, and the flanges 25A of the follower pins 25 engaged these bulging parts from outside along thickness direction. Thus, both cam plates 31 are prevented from being deflected away from each other and the follower pins 25 and the cam grooves 34 are held engaged.

The operation areas 37 extend in a direction oblique to both the connecting direction of the housings 10, 20 and the sliding direction of the slider 30 from entrances 34A at the fronts of the leading ends of the cam plates 31 towards substantially middle parts of the cam plates 31. Thus, the two housings 10, 20 can be connected by inserting the follower pins 25 of the second housing 20 into the entrances 34A of the cam grooves 34 when the slider 30 is at the standby position SP and then operating the slider 30 to generate a cam action by the engagement of the follower pins 25 and the cam grooves 34.

The play areas 36 are formed substantially parallel to the inserting direction ID of the slider 30 from the back ends of the operation areas 37 to back ends 34B of the cam grooves 34. Front edges 34C of the cam grooves 34 in the play areas 36 preferably have a slight forward inclination towards the back ends 34B of the cam grooves 34. The play areas 36 do not contribute to the connection of the two housings 10, 20, but can prevent the separation of the two housings 10, 20 by letting follower pins 25 engage the front edges 34C of the cam grooves 34 in the play areas 36 to cause a component of force to act in a direction to push the slider 30 towards or to the operation completing position OCP if the two housings 10, 20 are pulled away from each other while being completely connected. The detection ribs 41 can be pushed into the detection holes 35 when the follower pins 25 are in the play areas 36, thereby enabling the position of the slider 30 to be corrected to the operation completing position OCP by insufficient insertion correcting surfaces 41A to be described later.

A resilient locking piece 32 is arranged behind the cam grooves 34 in each cam plate 31 (as shown in FIG. 19) as seen in the forward and backward directions FBD. The resilient locking piece 32 is formed by a substantially U-shaped cut that penetrates the cam plate 31 in the thickness direction. Thus, a side of the resilient locking piece 32 towards the operable portion 33 is resiliently deformable substantially in and out with a side thereof toward the leading end of the cam plate 31 as a base. The inner side of the resilient locking piece 32 is thinned to provide a deformation space for the resilient locking piece 32. A lock projection 32A projects outward from the outer side of the free end of the resilient locking piece 32. The lock projections 32A engaged the locking recesses 53 of the space defining portion 13, as shown in FIG. 14, to hold the slider 30 at the standby position SP in the slider accommodating spaces S.

Two detection holes 35 are formed in the lateral edges of the cam plates 31 along the longitudinal direction at the rear side of the first housing 10 near the operable portion 33 and have open rear ends. As shown in FIG. 1, detection ribs 41 can be accommodated in the detection holes 35 through the insertion holes 27 when the slider 30 is at the operation completing position OCP.

Figure 23:
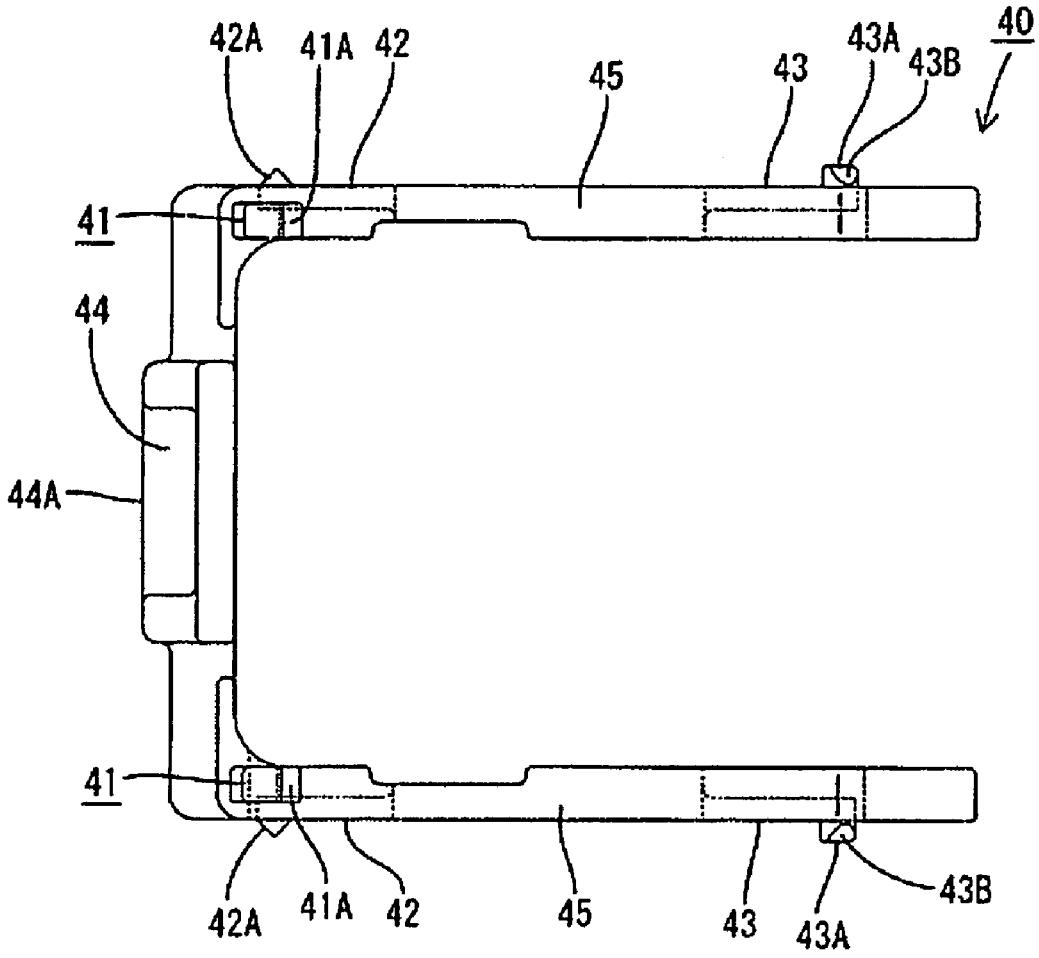
FIG. 23 is a front view of the detector.
Figure 24:
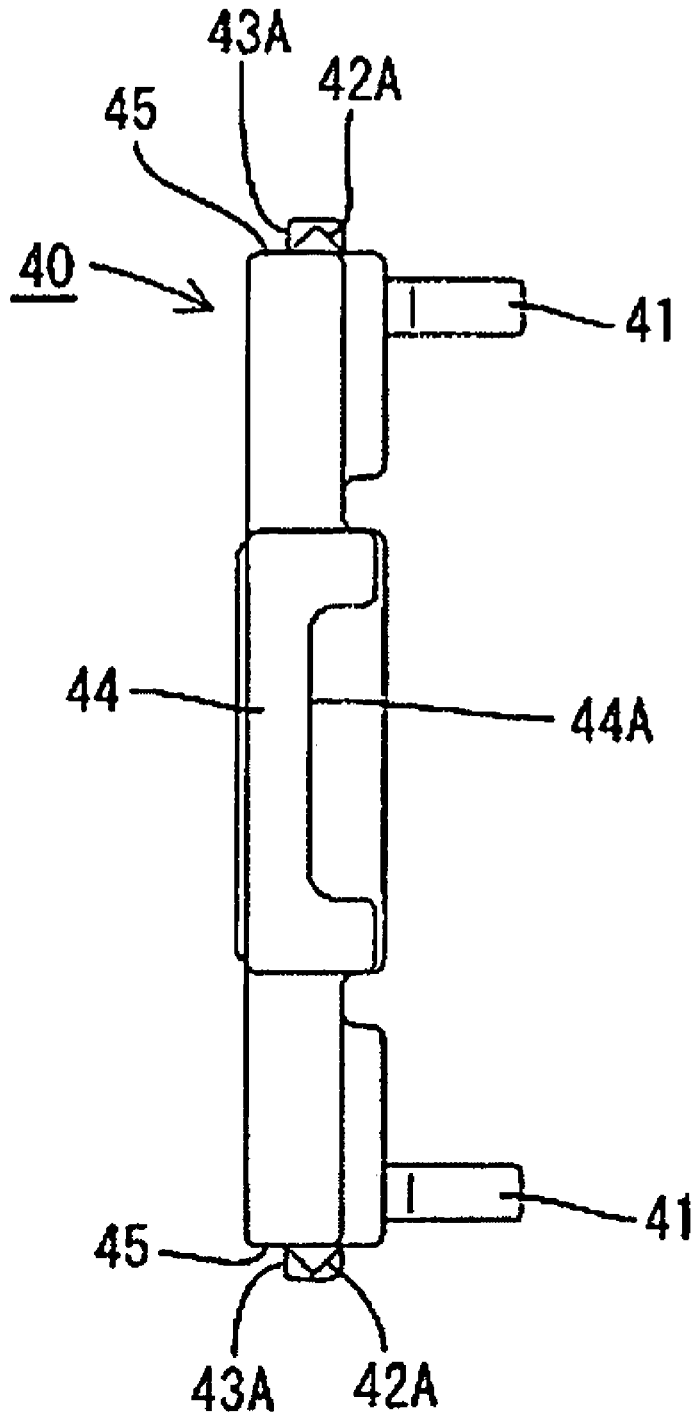
FIG. 24 is a side view of the detector.

The detector 40 is made e.g. of synthetic material and has a U-shape defined by a pressing portion 44 and two arms 45 at the opposite ends of the pressing portion 44, as shown in FIG. 23. The detector 40 is rotatable between an initial position IP and a detecting position DP by using the rotation supports 19B. A protrusion 44A projects out substantially in the middle of the pressing portion 44, and is between the vertical sections of the pair of L-shaped portions 19A vertically adjacent to each other, as shown in FIG. 8, when the detector 40 is at the detecting position DP. It should be noted that the initial position IP is a position of the detector 40 shown in FIG. 3 where detection ribs 41 interfere with the cam plates 31 and cannot be pushed into the slider accommodating spaces S. On the other hand, the detecting position DP is a position of the detector 40 shown in FIG. 1 where the detection ribs 41 align with the detection holes 35 to be pushed into the slider accommodating spaces S when the slider 30 reaches the operation completing position OCP.

The rotary shaft pieces 43 are at ends of the arms 45 opposite the pressing portion 44. Each rotary shaft piece 43 is formed by making a U-shaped cut through the corresponding arm 45 in the thickness direction and thinning an area enclosed by the cut. Thus, the leading end of the arm 45 can deform in and out with an end towards the pressing portion 44 as a base. A substantially cylindrical rotary shaft 43A projects out from the outer surface of the free end of each rotary shaft piece 43. Sides of the leading ends of the rotary shafts 43A to be assembled first into the rotation supports 19B have slanted guiding surfaces 43B for sliding in contact with the inner surface of the outer peripheral wall 19 during assembly to deform the rotary shaft pieces 43 in and to guide a smooth assembling operation.

Figure 22:
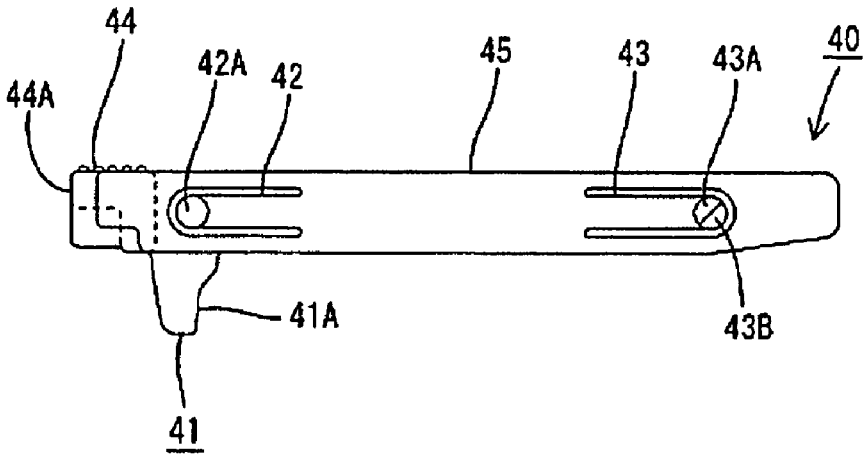
FIG. 22 is a plan view of the detector.

The locks 42 are arranged at ends of the outer surfaces of the arms 45 towards the pressing portion 44, as shown in FIG. 22. Each lock 42 is formed by a substantially U-shaped cut through the corresponding arm 45 in the thickness direction and thinning an area enclosed by this cut, so that a side thereof toward the pressing portion 44 is resiliently deformable in and out with a side towards the leading end of the arm 45 as a base. A converging lock projection 42A projects out from the outer surface of the free end of each lock 42. The lock projection 42A can releasably hold the detector 40 at the detecting position DP by entering the interlocking portions 19D by sliding in contact with the inner surface of the outer peripheral wall 19 to deform the locks 42 in as the detector 40 is rotated towards the detecting position DP.

As shown in FIG. 22, detection ribs 41 are arranged at positions of the lower surfaces of the arms 45 adjacent to the locks 42. The detection ribs 41 project substantially normal to the lengthwise direction of the arms 45, and can enter the slider accommodating spaces S through the insertion holes 27 along a rotation path when the detector 40 is rotated to the detecting position DP. The leading ends of the detection ribs 41 interfere with the cam plates 31 during operation of the slider 30 and cannot enter the slider accommodating spaces S, but align with the detection holes 35 to be accommodated into the slider accommodating spaces S when the slider 30 is at the operation completing position OCP. Thus, an operator can detect that the slider 30 is at the operation completing position OCP and that the two housings 10, 20 are connected if the operation of the detector 40 is permitted.

Figure 5:
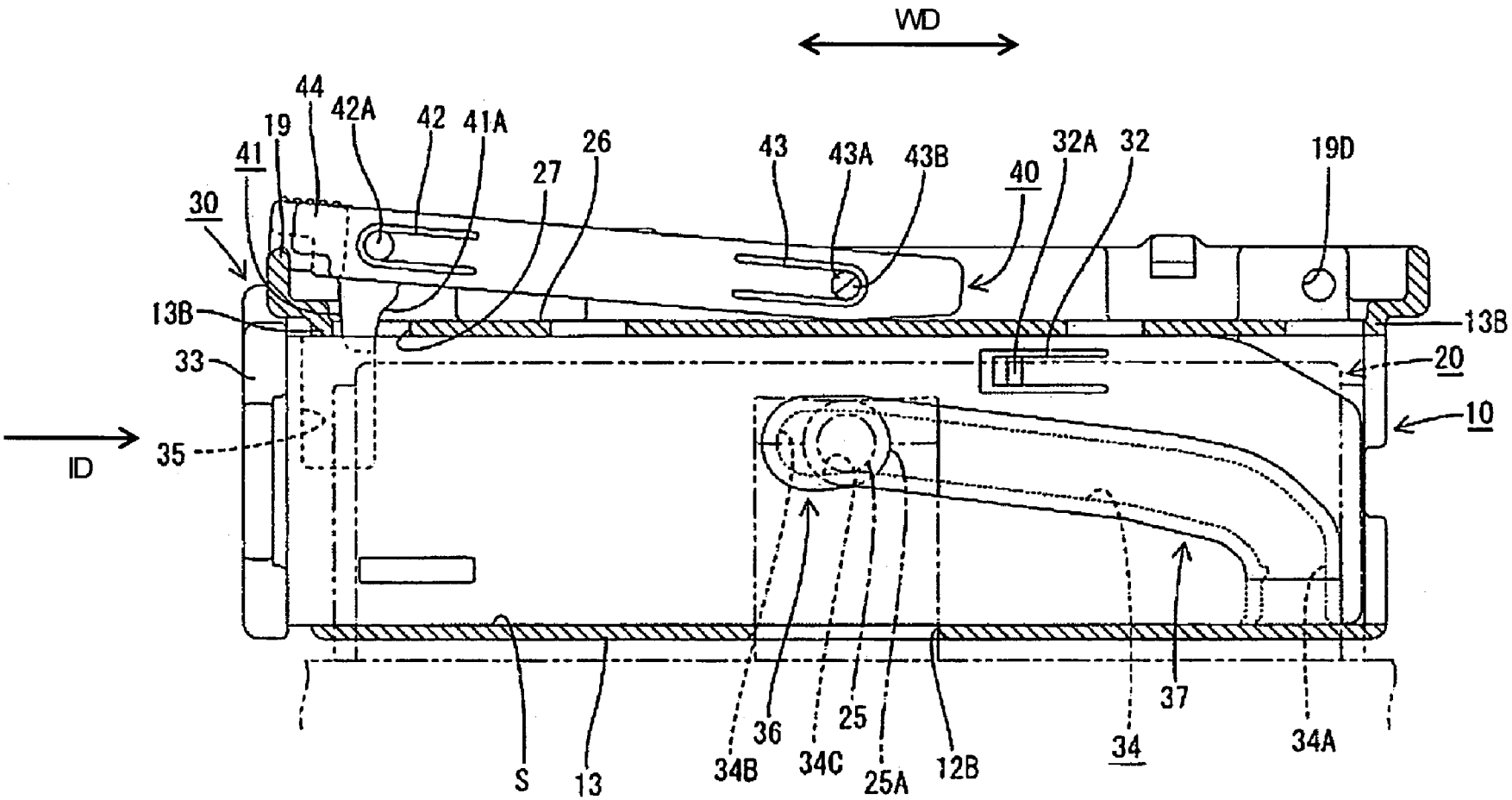
FIG. 5 is a horizontal section showing a state where the detector is pushed slightly towards slider accommodating spaces after the connecting operation is completed.
Figure 7:
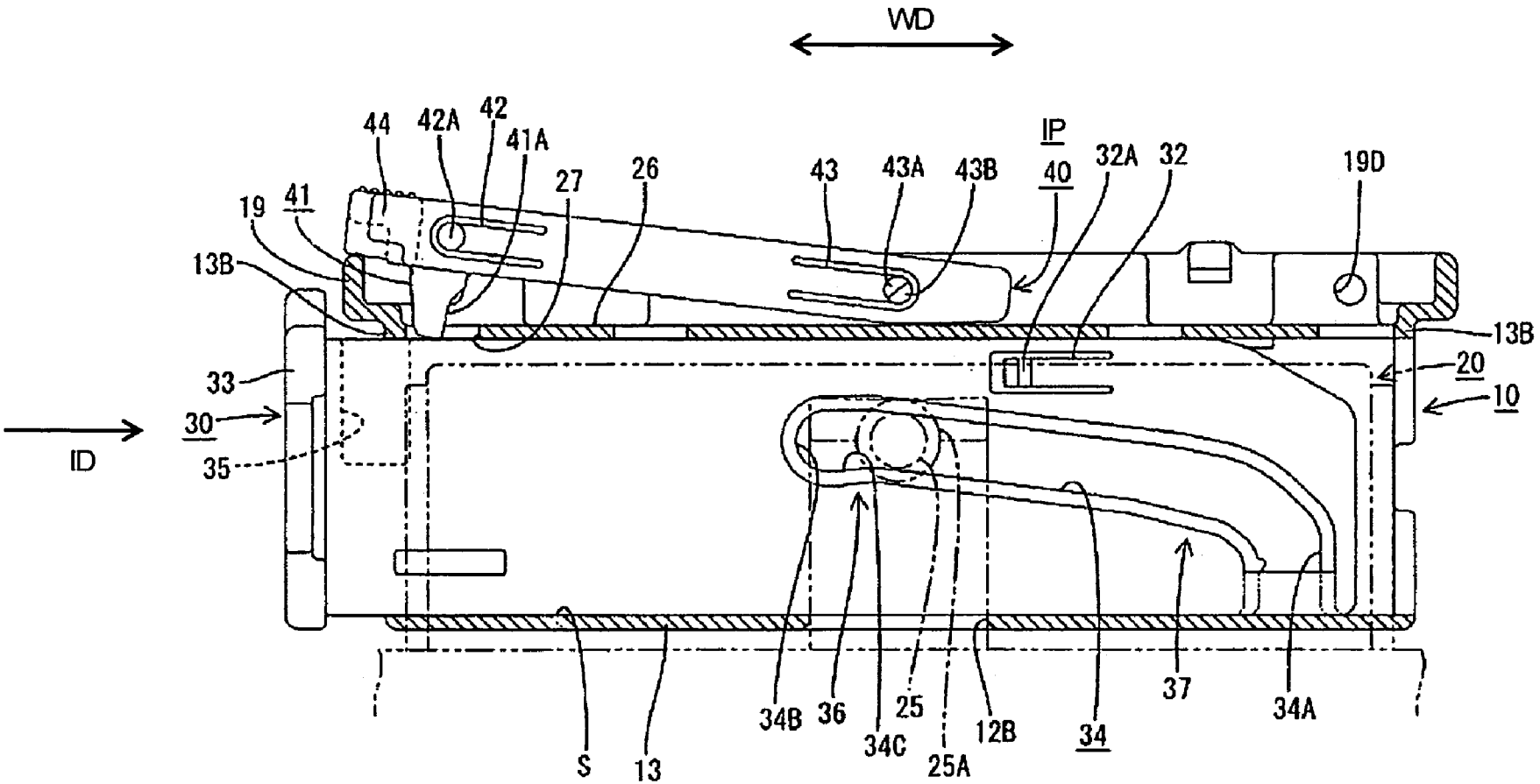
FIG. 7 is a horizontal section showing a state where the detector is at the initial position during a separating operation of the two housings.

The insufficient insertion correcting surfaces 41A are on surfaces of the detection ribs 41 facing the rotary shaft pieces 43 and are inclined to be more distanced from the rotary shafts 43A as they extend towards the leading ends of the detection ribs 41. The slider 30 may be inserted insufficiently even though the housings 10, 20 are connected completely. In this situation, the follower pins 25 have not reached the play areas 36. However, pushing forces on the detector 40 cause the insufficient insertion correcting surfaces 41A of the detection ribs 41 to slide in contact with the edges of the detection holes 35, as shown in FIG. 5, and a component of the force pushes the slider 30 to the operation completing position OCP. Conversely, the slider 30 can be slid from the operation completing position OCP in the detaching direction. In this situation, the detection ribs 41 are pushed out of the detection holes 35 while the insufficient insertion correcting surfaces 41A of the detection ribs 41 are held in sliding contact with the edges of the detection holes 35, and the detector 40 reaches the initial position IP. The leading sides of the arms 45 beyond the rotary shafts 43A are slanted at their surfaces facing the accommodating portion 26 so as not to interfere with the accommodating portion 26 when the detector 40 is at the initial position IP as shown in FIG. 7.

Figure 9:
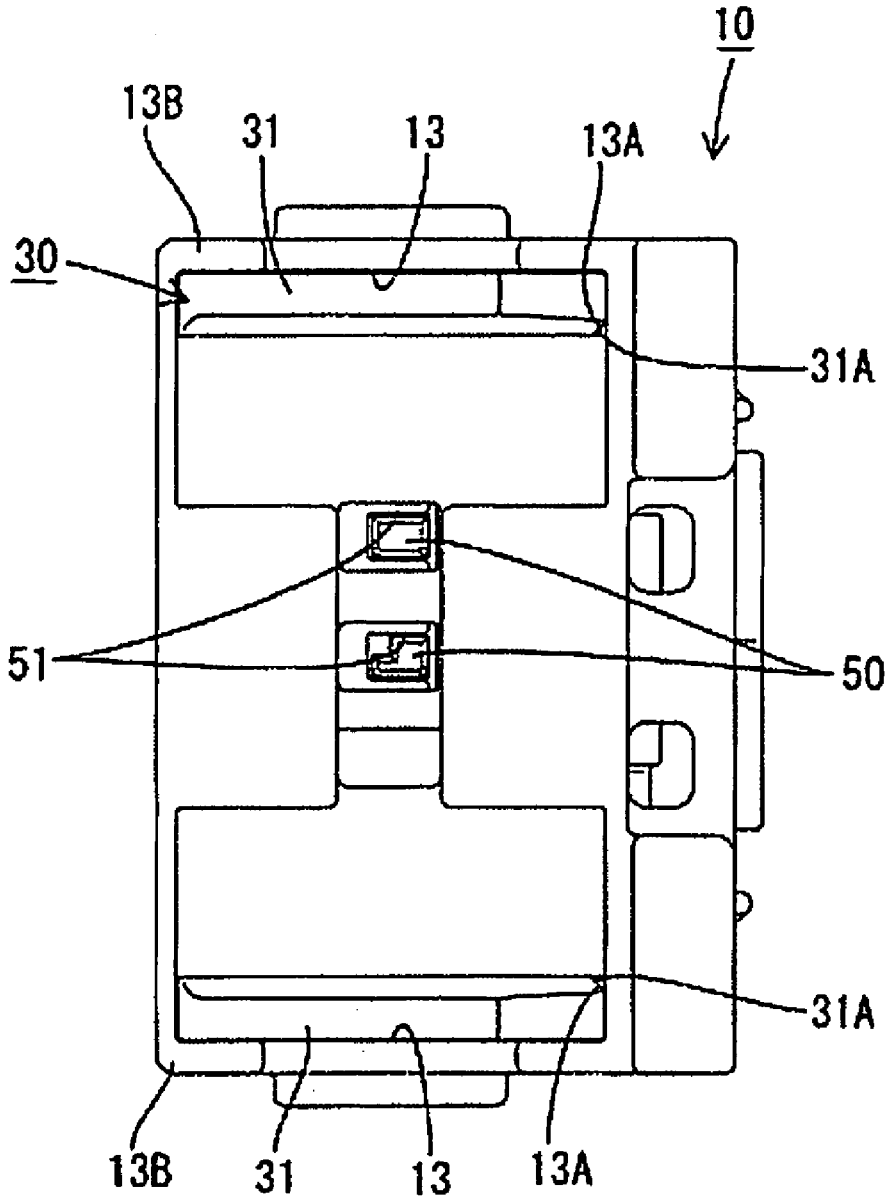
FIG. 9 is a side view showing the state where the detector is at the detecting position before the connecting operation.

The connector is assembled by inserting the slider 30 into the first housing 10. As shown in FIG. 13, the slider 30 can be assembled from either widthwise side of the slider accommodating spaces S, and the assembling direction is selected depending on the situation at the assembling site of the first and second housings 10 and 20. Upon assembling the slider 30, the chamfered surfaces 31A of the cam plates 31 oppose the slants 13A of the space defining portions 13, as shown in FIG. 9 to prevent the slider 30 from being inserted in an upside-down posture. The slider 30 then can be slid towards the operation completing position OCP.

The detector 40 is assembled into the first housing 10 so that the pressing portion 44 is at the same side as the operable portion 33 of the slider 30 with respect to the vertical axis passing the shaft holes 19C. The rotary shafts 43A then are fit into the shaft holes 19C while the slanted guiding surfaces 43B slide in contact with the inner surface of the outer peripheral wall 19. The rotary shaft pieces 43 initially deform in but then restore resiliently to assemble the detector 40 rotatably into the rotation supports 19B. The pressing portion 44 is pressed to push the detector 40 into the slider accommodating spaces S. The lock projections 42A slide in contact with the inner surface of the outer peripheral wall 19 so that the locks 42 deform. The locks 42 restore resiliently when the lock projections 42A fit into the interlocking portions 19D. As a result, the detector 40 is held releasably at the detecting position DP. In this way, the detection ribs 41 are accommodated into the detection holes 35 through the insertion holes 27 as shown in FIG. 1 and the detector 40 is accommodated into the accommodating portion 26, as shown in FIG. 8.

Figure 2:
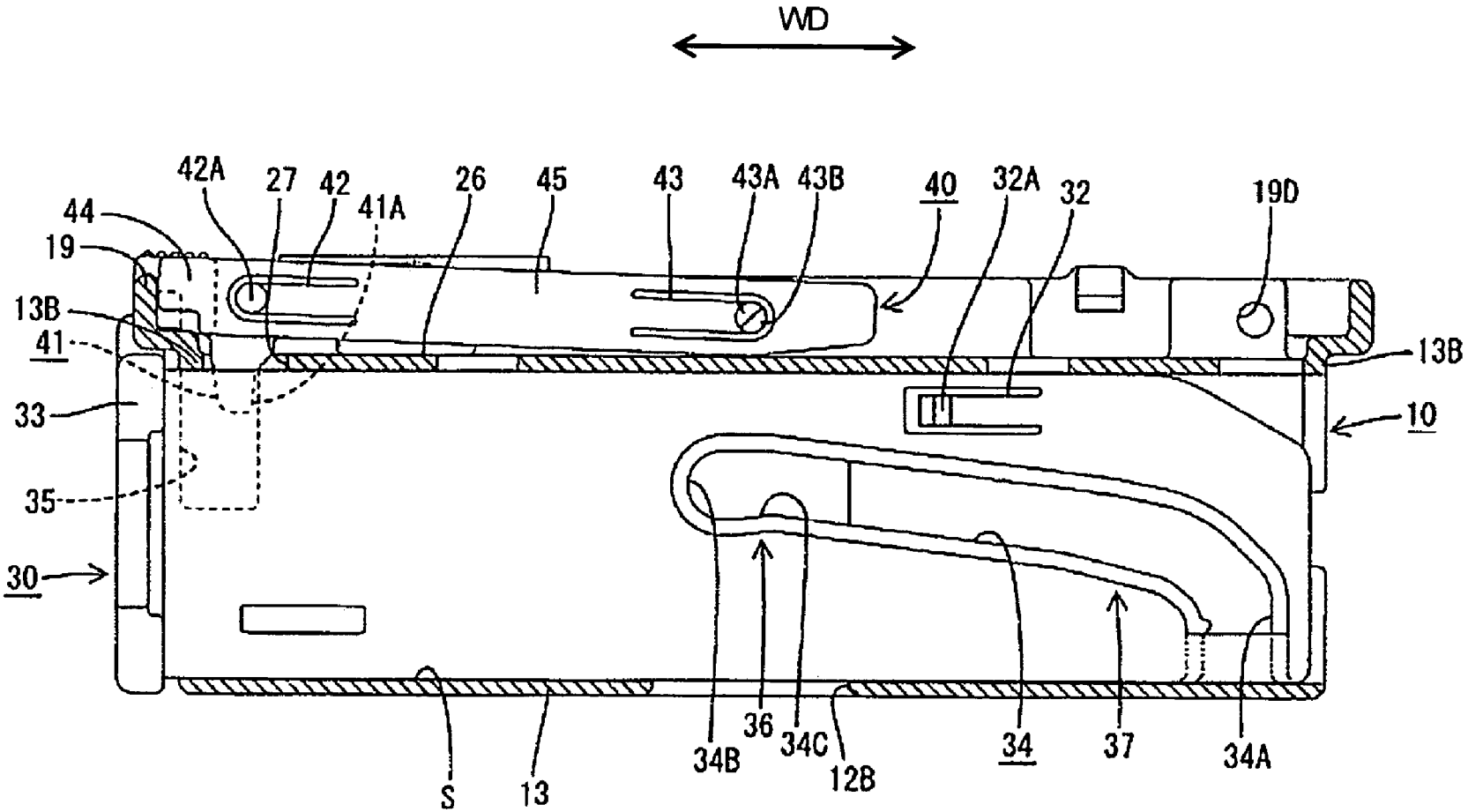
FIG. 2 is a horizontal section showing a state where the detector is pushed slightly from the detecting position before the connecting operation.

The slider 30 is at the operation completing position OCP in the slider accommodating spaces S when first housing 10 is transported to the assembling site to be assembled with the second housing 20. The slider 30 then is pulled back from the operation completing position OCP to the standby position SP to assemble the housings 10 and 20. As a result, the insufficient insertion correcting surfaces 41A of the detection ribs 41 slide in contact with the edges of the detection holes 35, as shown in FIG. 2, thereby causing a component of force to act in a direction for pushing the detection ribs 41 out of the detection holes 35. The lock projections 42A and the interlocking portions 19D then disengage. Additionally, the detection ribs 41 move onto the cam plates 31 and the detector 40 reaches the initial position IP shown in FIG. 3 when the slider 30 reaches the standby position SP. Movement of the slider 30 in the detaching direction from the standby position SP is prevented by the engagement of the upright surfaces of the lock projections 32A and the upright surfaces of the locking recesses 53 and an inadvertent movement of the slider 30 from the standby position SP to the operation completing position OCP is prevented by the engagement of the lock projections 32A with the moderately sloped surfaces of the locking recesses 53. The entrances 34A of the cam grooves 34 align with the escaping grooves 12B when the slider 30 is at the standby position SP and wait on standby to engage with the follower pins 25.

Figure 3:
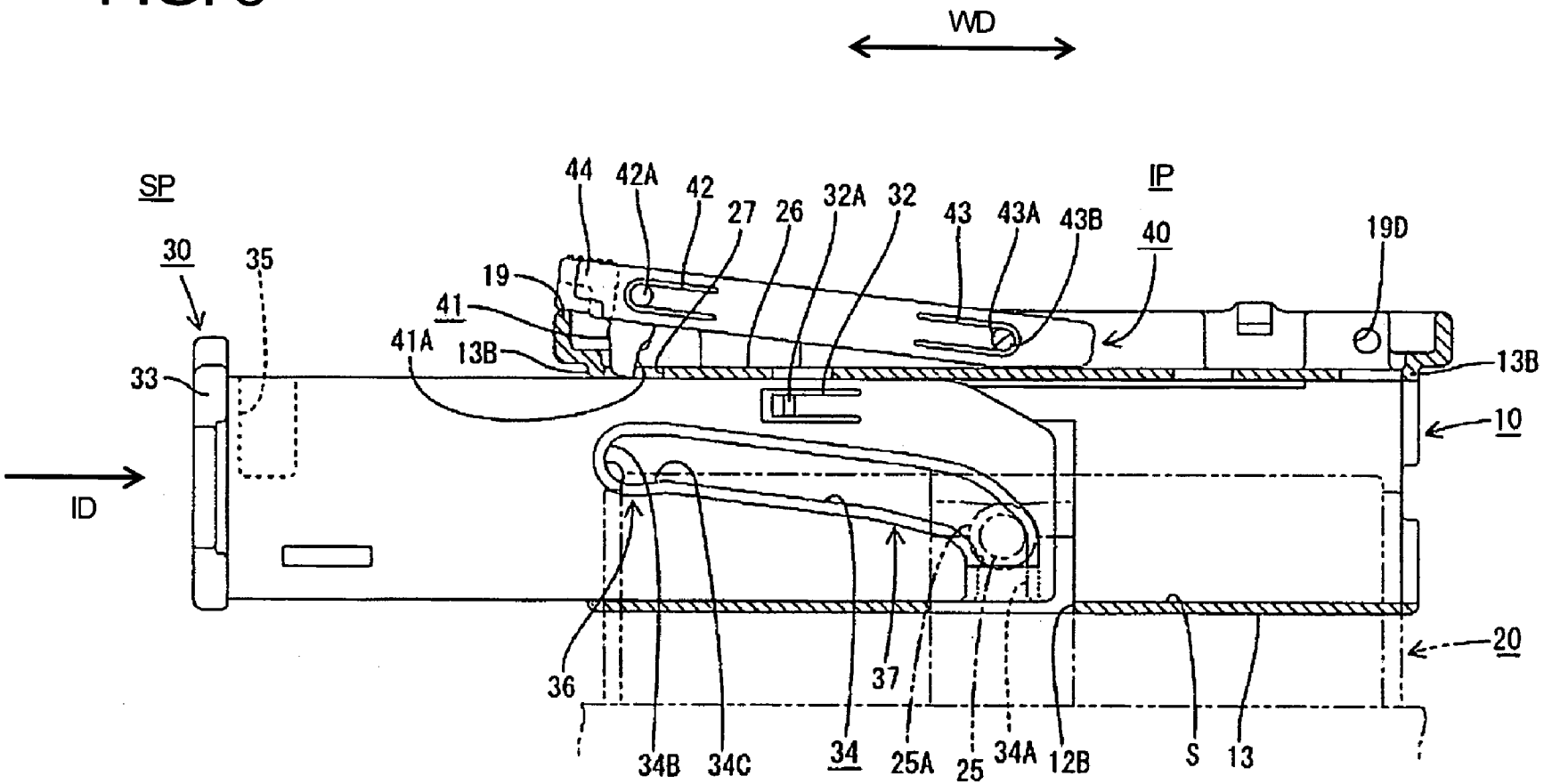
FIG. 3 is a horizontal section showing a state where the detector is at an initial position at an initial stage of the connecting operation.
Figure 11:
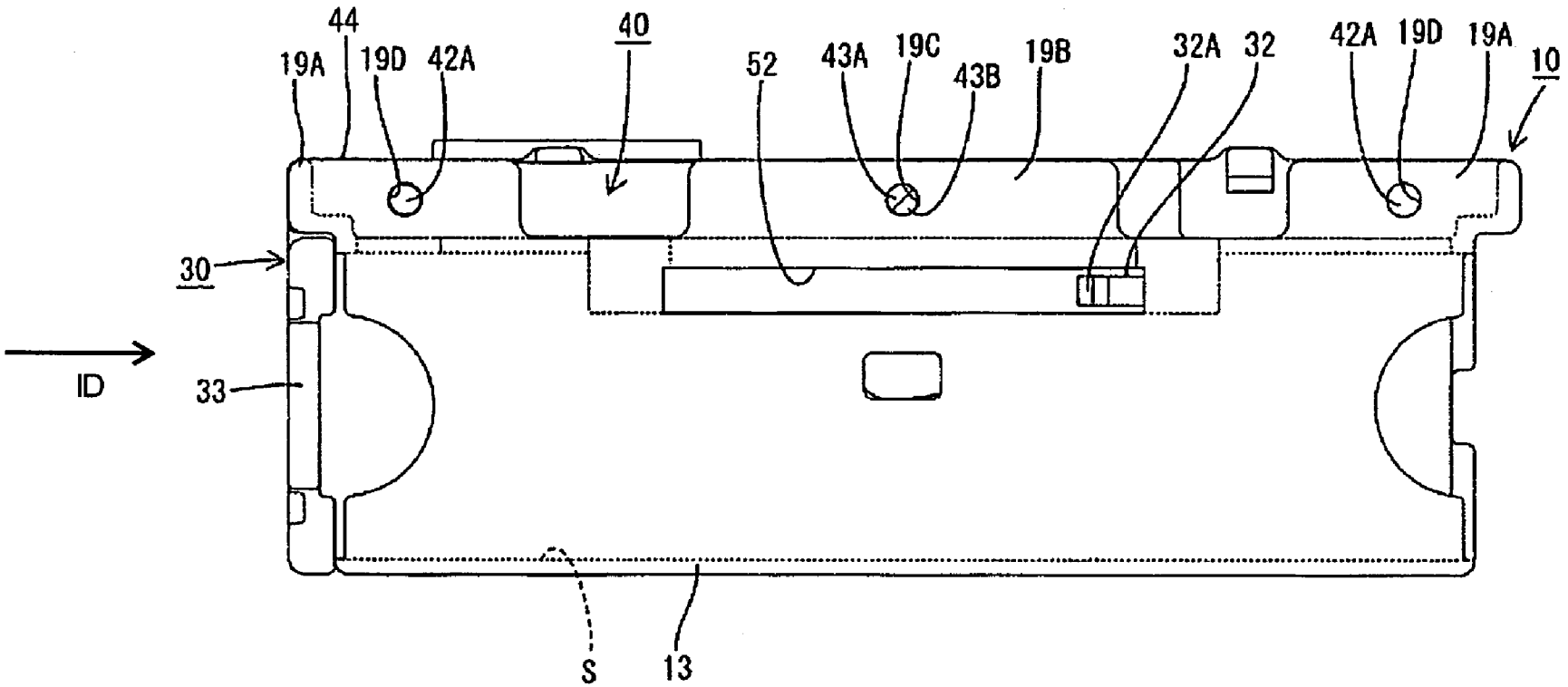
FIG. 11 is a plan view showing the state where the slider is at the operation completing position before the connecting operation.

The two housings 10, 20 then are fit lightly together. As a result, the guiding projections 24 of the second housing 20 enter the guiding recesses 12A of the first housing 10 to prevent the first housing 10 from being inserted into the second housing 20 in an upside-down posture and to achieve a smooth guiding. As shown in FIG. 3, the follower pins 25 are inserted into the entrances 34A of the cam grooves 34 through the escaping grooves 12B. The slider 30 then is slid towards the operation completing position OCP. As a result, the inclined surfaces of the lock projections 32A and the locking recesses 53 disengage to permit the slider 30 to move. The connecting operation of the two housings 10, 20 progresses due to the cam action of the follower pins 25 and the cam grooves 34. The lock projections 32A move over the inclined surfaces of the locking recesses 53 and enter the escaping spaces 52, as shown in FIG. 11. Thus, the operating force will not increase during the operation of the slider 30 due to the interference of the lock projections 32A and the space defining portions 13. Further, in an intermediate stage of the connecting operation of the two housings 10, 20 shown in FIG. 3, the leading ends of the detection ribs 41 of the detector 40 at the initial position interfere with the cam plates 31 to prevent the detection ribs 41 from being pushed toward the slider accommodating spaces S.

Figure 4:
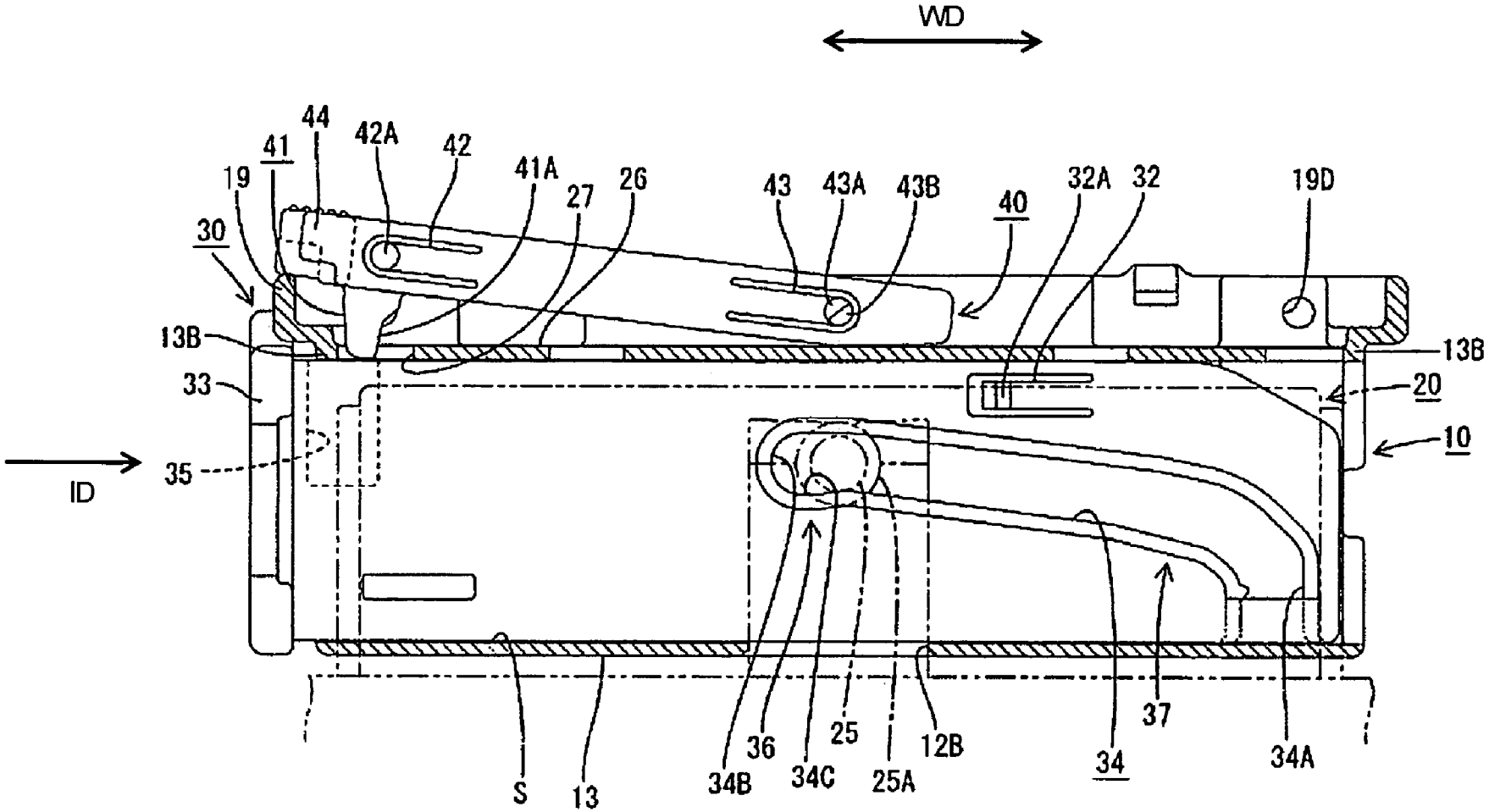
FIG. 4 is a horizontal section showing a state where the detector is at the initial position after the connecting operation is completed.

The follower pins 25 enter the play areas 36 when the slider 30 is slid sufficiently to connect the two housings 10, 20 completely (see FIG. 4). The detection ribs 41 of the detector 40 can be pushed from the initial position and into the detection holes 35 when the housings 10, 20 are connected completely. The pressing portion 44 on the rear surface of the first housing 10 is not aligned with the recess 26A when the detector 40 is at the initial position IP and while the detector 40 is being moved toward the detecting position DP. Therefore an operator easily can judge from the external appearance that the detector 40 has not yet reached the detecting position. The leading ends of the detection ribs 41 enter the detection holes 35 through the insertion holes 27 if the detector 40 is pushed to the detecting position DP, and the insufficient insertion correcting surfaces 41A of the detection ribs 41 slide in contact with the edges of the detection holes 35 as shown in FIG. 5. As a result, the slider 30 can be pushed to the operation completing position OCP. In the meantime, the follower pins 25 move towards the back ends 34B of the cam grooves 34 in the play areas 36, and the complete connection of the two housings 10, 20 can be guaranteed when the slider 30 is pushed to the operation completing position OCP.

Figure 6:
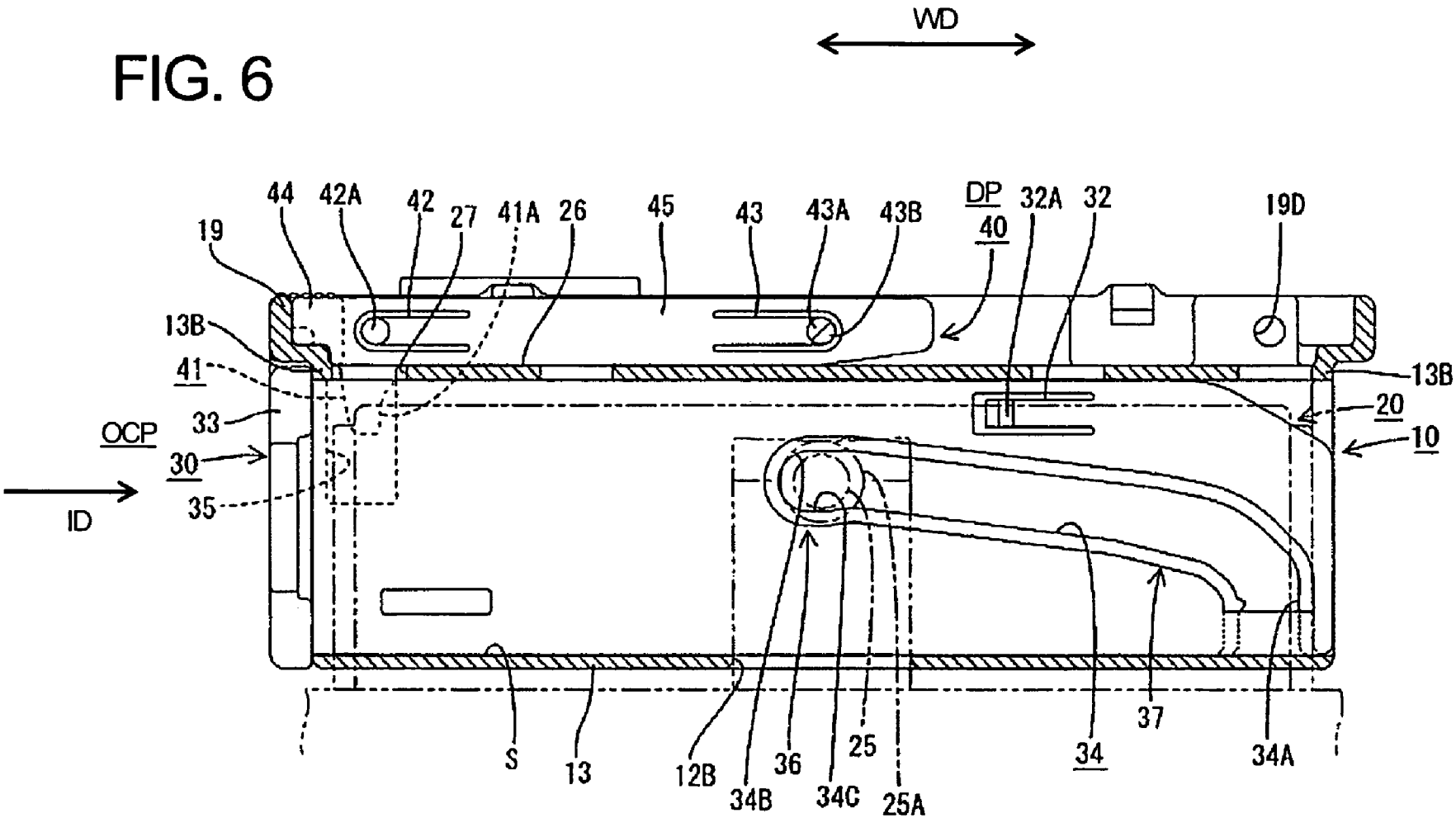
FIG. 6 is a horizontal section showing a state where the detector is at the detecting position after the connecting operation is completed.

The detection ribs 41 are in the detection holes 35 when the detector 40 reaches the detecting position DP and the slider 30 reaches the operation completing position OCP, as shown in FIG. 6. Further, the lock projections 42A engage the interlocking portions 19D to hold the detector at the detecting position DP. The detector 40, of course, can be pushed to the detecting position DP after the slider 30 is inserted to the operation completing position OCP. The completely connected state of the two housings 10, 20 can be judged easily from the external appearance in at least three was. First, the projected position of the protrusion 44A of the pressing portion 44 on the rear surface of the first housing 10 substantially conforms to the position of the recess 26A, as shown in FIG. 8, when the detector 40 is rotated to the detecting position DP. Second, the outer surfaces of the vertical sections of the L-shaped portions 19A, the operable portion 33 of the slider 30 and the protrusion 44A of the pressing portion 44 are flush with each other when the detector 40 is at the detecting position DP. Third, the rear edges of the arms 45 do not bulge back from the rear edge of the outer circumferential wall 19 and the operable portion 33 is fit below the vertical sections of the L-shaped portions 19A.

To separate the two housings 10, 20, the slider 30 is slid in detaching direction. As a result, the insufficient insertion correcting surfaces 41A of the detection ribs 41 slide in contact with the edges of the detection holes 35. Thus, the detection ribs 41 are pushed out of the detection holes 35 and move onto the cam plates 35 and the detector 40 reaches the initial position IP (see FIG. 7). Accordingly, the detector 40 need not be pushed to the initial position IP prior to the separating operation, thereby improving operation efficiency. The slider 30 then is moved in detaching direction from the state of FIG. 7, and separation of the housings 10, 20 progresses by the cam action of the follower pins 25 and the cam grooves 34. The follower pins 25 are at the entrances 34A of the cam grooves 34 when the slider 30 reaches the standby position SP and the housings 10, 20 can be pulled apart.

The detector 40 is assembled rotatably and is exposed at the outer surface of the first housing 10. Thus, the position of the detector 40 can be confirmed easily by eye even from the back side of the first housing 10 since the detector 40 moves across an operator's gaze. In contrast, the prior art detector has a parallel movement. Accordingly, there is no deviation in the projected position of any part of the detector on the first housing when the detector is at the initial position and when the detector is at the detecting position. This is a particular problem if the gaze of the operator lies at the back side with respect to the moving direction of the detector. Thus, the operator cannot recognize a difference between the detecting position and the initial position of the prior art detector. However, the subject detector 40 is mounted rotationally, and there is a deviation in the projected position when the detector 40 is at the initial position IP and when the detector 40 is at the detecting position DP even if the gaze should lie at a position as described above. Therefore, an operator can clearly recognize whether the detector 40 has reached the detecting position DP.

The detector 40 cannot be pushed into the slider accommodating spaces S during the operation of the slider 30 because of the sliding contact of the detection ribs 41 with the slider 30. However, the detection ribs 41 can be aligned with the detection holes 35 and the detector 40 can be pushed to the detecting position DP when the slider 30 substantially reaches the operation completing position OCP. Therefore, the arrival of the detector 40 at the detecting position DP can be detected.

The detection ribs 41 have the insufficient insertion correcting surfaces 41A. Thus, a pushing force on the detector 40 moves the insufficiently inserted slider 30 to the operation completing position OCP. Additionally, pulling the slider 30 from the operation completing position OCP in detaching direction automatically pushes the detection ribs 41 out of the detection holes 35. Therefore, an additional operation of pushing the detector 40 up from the detecting position DP to the initial position IP is unnecessary, and operation efficiency is improved.

Each cam groove 34 has the operation area 37 for completely connecting the two housings 10, 20 and the play area 36 that is continuous with the back side of the operation area 37. The play area 36 does not cause the connecting operation to progress further after the complete connection even if the slider 30 is slid. The completely connected state of the two housings 10, 20 is guaranteed when the detection ribs 41 of the detector 40 are accommodated into the detection holes 35 while the follower pins 25 are in the play areas 36. If the two housings 10, 20 are pulled away from each other in the completely connected state, the follower pins 25 and the front edges 34C of the cam grooves 34 in the play areas 36 engage to cause a component of force to act in a direction toward the operation completing position OCP, thereby maintaining the completely connected state.

The slider accommodating spaces S penetrate the first housing 10 in the width direction WD so that the slider 30 can be assembled from either widthwise side. Additionally, the rotation supports 19B are at substantially symmetrical positions in the first housing 10 so that the assembling position of the detector 40 is selectable depending on the assembling direction of the slider 30. Thus, the assembling direction of the slider 30 can be selected depending on the situation at the assembling site of the two housings 10, 20.

The rotation supports 19B are commonly used and the assembling position of the detector 40 can be changed depending on the assembling direction of the slider 30. Therefore, it is not necessary to form two shaft holes 19C, which can simplify the construction and save space.

The detector 40 has rotation preventing means that engages the first housing 10 when the detector 40 reaches the detecting position DP to prevent the detector 40 from rotating in a returning direction. Thus inadvertent rotation of the detector 40 at the detecting position DP is prevented.

The rotation preventing means includes the resiliently deformable locks 42 on the detector 40 and the interlocking portions 19D on the first housing 10. The locks 42 move over the interlocking portions 19D and then restore resiliently to engage the interlocking portions 19D. Thus, the detecting operation also can be confirmed through the feeling given upon the engagement of the locks 42 and the interlocking portions 19D.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The detection ribs 41 are provided on the detector 40 in the foregoing embodiment. However, they may be provided on the slider 30 according to the present invention. In such a case, the detector 40 is formed with the detection holes 35. With such an arrangement, it is not necessary to form holes in the slider 30 and the strength of the slider 30 can be ensured.

The follower pins 25 engage the front edges 34C of the cam grooves 34 in the play areas 36 to generate a force with a component that urges the slider 30 towards the operation completing position in the foregoing embodiment. However, it is sufficient that the play areas 36 do not contribute to the connecting operation according to the invention. For example, the front edges 34C of the cam grooves 34 in the play areas 36 may be substantially parallel to the sliding direction of the slider 30.

Insufficient insertion is corrected by the insufficient insertion correcting surfaces 41A while the follower pins 25 are in the play areas 36 in the foregoing embodiments. However, insufficient insertion may be corrected while the follower pins 25 are in the operation areas 37 during the connecting operation of the two housings 10, 20.

The rotary shafts 43A are provided on the detector 40 in the foregoing embodiment. However, the rotary shafts 43A may be provided on the first housing 10 and the shaft holes 19 may be formed in the slider 30 according to the invention. In this case, the rotary shafts 43A may be used commonly.

The detector 40 is provided with the locks 42 in the foregoing embodiment. However, the first housing 10 may be provided with the locks 42 and the detector 40 may be provided with the interlocking portions 19D.

The rotation preventing means includes the resiliently deformable locks 42 move over the interlocking portions 19D and then resiliently restore to engage the interlocking portions 19D in the foregoing embodiment. However, a compressible resilient member may be provided between the locks 42 and the interlocking portions 19D and the detector 40 may be locked in position by frictional resistance so as not to rotate.

The detection holes 35 are formed in the slider 30 in the foregoing embodiment. However, other modes may be adopted provided that the detector 40 is rotatable. For example, the detection holes 35 may be formed in the receptacle 21 of the second housing 20 so that the detection ribs 41 cannot be pushed into the detection holes 35 by being held in sliding contact with the outer surface of the receptacle 21 during the connection of the two housings 10, 20 and the detection ribs 41 can enter the detection holes 35 and the detector 40 can be pushed only after the two housings 10, 20 are connected completely.

The linearly movable slider 30 is the preferred movable member. However, the invention is applicable to movable members having nonlinear operation paths, such as bent paths or rotational paths, as for a rotatable lever.

Although the detector 40 described above is rotatable, the invention also is applicable to detectors 40 being movable in a different way such as in a substantially linear manner.

What is claimed is:

1. A connector, comprising:

a housing connectable with a mating housing that has at least one mating cam;

a movable member assembled to the housing for movement at an angle to a connecting direction of the housing with the mating housing, the movable member having at least one cam engageable with the mating cam and configured to generate a cam action for connecting the housings when the movable member is moved; and a detector at least partly exposed at an outer surface of the housing and being rotatably mounted to the housing, the detector being rotatable to a detecting position when the movable member is at an operation completing position corresponding to proper connection of the housing with the mating housing, the detector being prevented from rotating to the detecting position during movement of the movable member towards the operation completing position.

2. The connector of claim 1, wherein the detector is assembled at a position to substantially face an entrance path for the movable member in the housing, one of the detector and the movable member including a detection rib disposed for sliding contact with the other of the detector and the movable member during operation of the movable member to prevent the detector from being pushed toward the entrance path.

3. The connector of claim 2, wherein the other of the detector and the movable member has at least one detection hole for receiving the detection rib, and the detector can be pushed to the detecting position only after the movable member substantially reaches the operation completing position.

4. The connector of claim 3, wherein the detection rib has at least one insufficient insertion correcting surface aligned to cause a component of force to act in a direction to urge the movable member to the operation completing position by sliding in contact with an edge of the detection hole if the movable member is inserted insufficiently.

5. The connector of claim 2, wherein the cam includes an operation area aligned for connecting the housings and a play area substantially continuous with a back end of the operation area, the play area being disposed and aligned so that movement of the movable member while the mating cam is in the play area does not cause a connecting operation to progress after the complete connection, and the detection rib being pushed into the detection hole while the mating cam is in the play area.

6. The connector of claim 2, wherein the entrance path for the movable member penetrates the housing, and the movable member can be selectively assembled from either end of the entrance path, and movement supports being arranged at substantially symmetrical positions in the housing for making an assembling position of the detector selectable depending on an assembling direction of the movable member.

7. The connector of claim 6, wherein the movement supports are used for the detector for both assembling directions of the movable member.

8. The connector of claim 1, wherein the detector includes movement preventing means for engaging the housing when the detector reaches the detecting position and locking the detector so as not to move in a returning direction.

9. The connector of claim 8, wherein the movement preventing means includes at least one resiliently deformable lock provided at one of the detector and the housing and an interlocking portion provided at the other and engageable with the lock after the lock is restored upon moving over the interlocking portion.

10. A connector assembly comprising the connector of claim 1 and a mating connector connectable therewith.

11. The connector of claim 1, wherein the housing is configured to accommodate substantially linear movement of the moveable member.

12. The connector of claim 11, wherein the moveable member is moveable substantially linearly in a direction substantially normal to the connecting direction of the housing with the mating housing.

13. A connector assembly, comprising:

a housing;

a mating housing configured for connection with the housing along a connecting direction, the mating housing being formed with at least one mating cam;

a slider assembled to the housing for movement substantially linearly relative to the housing in a direction substantially normal to the connecting direction, the slider having at least one cam engageable with the mating cam and configured to generate a cam action for connecting the housing and the mating housing when the slider is moved; and a detector rotatably mounted to the housing and at least partly exposed at an outer surface of the housing, the detector being rotatable to a detecting position when the slider is at an operation completing position corresponding to complete connection of the housing with the mating housing, the detector being preventing from rotating to the detecting position during movement of the slider towards the operation completing position.

14. The connector of claim 13, wherein the slider is formed with at least one detection hole, and wherein the detector is formed with at least one detection rib, the detection rib being slidably engageable with a surface of the slider as the slider is moved towards the operation completing position, the detection rib being aligned with the detection hole when the slider reaches the operation completing position so that the detector can be rotated to the detecting position with the detection rib being disposed in the detection hole when the detector is at the detecting position.

15. The connector of claim 14, wherein the detector includes movement preventing means for engaging the housing when the detector reaches the detecting position and locking the detector so as not to move in a returning direction.

16. The connector of claim 15, wherein the movement preventing means includes at least one resiliently deformable lock provided at one of the detector and the housing and an interlocking portion provided at the other of the detector and the housing, the interlocking portion being engageable with the lock after the lock is restored upon moving over the interlocking portion.

* * * * *